US010703623B1

(12) United States Patent
Main et al.

(10) Patent No.: US 10,703,623 B1
(45) Date of Patent: Jul. 7, 2020

(54) FUEL NOZZLE

(71) Applicant: FRANKLIN FUELING SYSTEMS, LLC, Madison, WI (US)

(72) Inventors: Adam Main, McFarland, WI (US); Jim Novak, Sun Prairie, WI (US)

(73) Assignee: Franklin Fueling Systems, LLC, Madison, WI (US)

( * ) Notice: Subject to any disclaimer, the term of this patent is extended or adjusted under 35 U.S.C. 154(b) by 288 days.

(21) Appl. No.: 15/827,668

(22) Filed: Nov. 30, 2017

Related U.S. Application Data

(60) Provisional application No. 62/428,292, filed on Nov. 30, 2016.

(51) Int. Cl.

| | |
|---|---|
| ***B67D 7/54*** | (2010.01) |
| ***B67D 7/36*** | (2010.01) |
| ***B67D 7/42*** | (2010.01) |
| ***B67D 7/34*** | (2010.01) |

(52) U.S. Cl.
CPC ..... *B67D 7/54* (2013.01); *B67D 7/34* (2013.01); *B67D 7/36* (2013.01); *B67D 7/42* (2013.01); *B67D 2007/545* (2013.01)

(58) Field of Classification Search
CPC ..... B67D 7/42; B67D 7/54; B67D 2007/545
See application file for complete search history.

(56) References Cited

U.S. PATENT DOCUMENTS

| | | | | |
|---|---|---|---|---|
| 3,502,121 | A | 3/1970 | Moore et al. | |
| 3,593,762 | A * | 7/1971 | Johnson | B67D 7/48 141/207 |
| 3,982,571 | A | 9/1976 | Fenton et al. | |
| 4,121,635 | A | 10/1978 | Hansel | |
| 4,343,337 | A | 8/1982 | Healy | |
| 5,085,258 | A | 2/1992 | Fink, Jr. et al. | |
| 5,121,777 | A | 6/1992 | Leininger et al. | |
| 5,127,451 | A | 7/1992 | Fink, Jr. et al. | |
| 5,178,197 | A | 1/1993 | Healy | |
| 5,386,859 | A | 2/1995 | Healy | |
| 5,421,382 | A | 6/1995 | Leininger et al. | |
| 5,655,576 | A | 8/1997 | Leininger et al. | |
| 6,698,471 | B1 | 3/2004 | Carmack | |
| 7,082,972 | B1 | 8/2006 | Healy | |
| 7,406,988 | B2 | 8/2008 | Mitchell | |
| 8,997,804 | B2 | 4/2015 | Grantham et al. | |
| 9,242,849 | B2 | 1/2016 | Kunter et al. | |
| 10,273,137 | B2 * | 4/2019 | Garrison | B67D 7/344 |
| 2006/0185759 | A1 | 8/2006 | Healy | |

FOREIGN PATENT DOCUMENTS

| | | |
|---|---|---|
| EP | 0 460 296 | 12/1991 |

* cited by examiner

*Primary Examiner* — Timothy P. Kelly

(74) *Attorney, Agent, or Firm* — Faegre Drinker Biddle & Reath LLP

(57) ABSTRACT

A fuel dispensing nozzle of a fuel dispensing system comprising a lockout mechanism that prevents the delivery of fuel when the fuel nozzle is not inserted into a fuel reservoir. The fuel dispensing nozzle includes a lookout plunger selectively restrained from movement by a rocker arm. The rocker arm maintains a freely moveable condition or a constrained turn movement condition based on the status of the fuel nozzle.

10 Claims, 17 Drawing Sheets

FUEL NOZZLE

CROSS-REFERENCE TO RELATED APPLICATIONS

The present application claims the benefit of U.S. Provisional Patent Application Ser. No. 62/428,292, filed on Nov. 30, 2016, and entitled "FUEL NOZZLE," the complete disclosure of which is expressly incorporated by reference herein.

FIELD OF THE DISCLOSURE

The present disclosure relates generally to a fuel nozzle of a fuel dispensing system, and more specifically, to a fuel nozzle of a fuel dispensing system comprising a lockout mechanism that prevents the delivery of fuel when the fuel nozzle is not in contact with a fill pipe or inlet of, e.g., a vehicle or container.

BACKGROUND OF THE DISCLOSURE

Fuel is generally delivered to a fuel reservoir (e.g., a fuel tank of a car, a fuel container, etc.) from a fuel dispenser using a fuel dispensing nozzle. In many situations, it is desirable that the fuel dispensing nozzle be capable of preventing the delivery of fuel when the fuel nozzle is not in contact with an inlet or fill pipe of a vehicle or container. Therefore, there is a need for a fuel dispensing nozzle including a lockout assembly that prevents the fuel dispensing nozzle from delivering fuel when the fuel nozzle is not in contact with a fill pipe of a vehicle or container by preventing the main valve of the fuel nozzle from being actuated to an open position allowing flow of fuel through the nozzle.

SUMMARY OF THE DISCLOSURE

A fuel dispensing nozzle is disclosed for delivery of liquid fuel from a source of liquid fuel to a fuel reservoir that includes a lockout assembly configured to prevent the delivery of fuel when the nozzle is not properly inserted into the fuel reservoir. The lockout assembly prevents the delivery of fuel by preventing the main valve of the fuel nozzle from being actuated to an open position allowing flow of fuel through the nozzle.

According to an exemplary embodiment of the present disclosure, a fuel dispensing nozzle comprises a nozzle body, the nozzle body defining a nozzle body fuel passageway and a diaphragm cavity, a fuel delivery spout extending from the nozzle body, the fuel delivery spout defining a spout fuel passageway, the nozzle body fuel passageway in fluid communication with the spout fuel passageway to form a nozzle passageway capable of conveying a quantity of fuel from a source of the quantity of fuel through the nozzle body and the spout to a fuel reservoir, a fuel valve disposed in the nozzle passageway, the fuel valve actuatable to allow a flow of the fuel through the nozzle passageway, a lockout plunger including a longitudinal axis, the lockout plunger having an active configuration allowing actuation of fuel valve and an inactive configuration preventing actuation of the fuel valve, a rocker arm rotatably supported relative to the nozzle body, the rocker arm rotatable to a stop position maintaining the lockout plunger in the inactive configuration preventing actuation of the fuel valve, and a spring positioned and oriented to selectively supply a spring bias to the rocker arm, the rocker arm rotatable over a range of motion, the rocker arm having an operative condition in which the rocker arm is freely rotatable over the range of motion, whereby the spring bias does not influence movement of the rocker arm in the operative condition, the rocker arm having a stop condition in which the spring bias maintains the rocker arm in the stop position to maintain the lockout plunger in the inactive configuration preventing actuation of the fuel valve.

In certain embodiments, the spring is positioned outside of the diaphragm cavity.

In certain embodiments, the fuel dispensing nozzle further comprises a push rod selectively engageable with the rocker arm, the spring supplying the spring bias to the rocker arm by supplying the spring bias to the push rod to bias the push rod to engage the rocker arm and maintain the rocker arm in the stop position.

In certain embodiments, the spring is positioned about the push rod.

In certain embodiments, the push rod has an actuated position in which the push rod disengages the rocker arm and the rocker arm can freely rotate from the stop position, the push rod positioned to be actuated to the actuated position by insertion of the spout into the fuel reservoir.

In certain embodiments, the active configuration of the lockout plunger comprises a stationary configuration of the lockout plunger, and the fuel dispensing nozzle further comprises a nozzle lever pivotable about a pivot extending from the plunger to actuate the fuel valve to allow the flow of the fuel through the nozzle passageway, wherein the inactive configuration of the plunger comprises a moveable configuration of the plunger, whereby the pivot is moveable in the inactive configuration to prevent the nozzle lever from actuating the fuel valve to allow the flow of the fuel through the nozzle passageway.

In certain embodiments, the nozzle body comprises a plurality of passages extending from an exterior of the nozzle body inward, each of the plurality of passages having one of a consistent cross-sectional size throughout a length of the passage and a decreasing cross-sectional size throughout the length of the passage, whereby no buried passages are formed in the nozzle body and whereby, owing to the lack of buried passages, the nozzle body can be die cast, and wherein the fuel dispensing nozzle further comprises a partition selectively securable in at least one of the plurality of passages to fluidly seal a portion of the at least one of the plurality of passages to define a pair of passages, each terminating at the partition, at least one of the pair of passages comprising a buried passage.

In certain embodiments, the spout defines a blind bore formed in a wall of the spout, the blind bore defining an opening in the wall of the spout and running from the opening to a terminal end defined within the wall, the push rod positioned in the blind bore.

In certain embodiments, the rocker arm includes a first end having a cutout between a pair of protrusions, and a first end of the push rod is positioned within the cutout of the rocker arm, the first end of the push rod comprising a bulbous end positionable to bear against the pair of protrusions in the stop position of the push rod.

In certain embodiments, the rocker arm further includes a second end, the second end including a first protrusion and a second protrusion separated by a gap, the longitudinal axis of the plunger intersecting the gap between the first protrusion and the second protrusion at the second end of the rocker arm.

According to an exemplary embodiment of the present disclosure, a fuel dispensing nozzle comprises a nozzle body, the nozzle body defining a nozzle body fuel passageway, a fuel delivery spout extending from the nozzle body, the fuel delivery spout defining a spout fuel passageway, the nozzle body fuel passageway in fluid communication with the spout fuel passageway to form a nozzle passageway capable of conveying a fuel from a source of the fuel through the nozzle body and the spout to a fuel reservoir, a fuel valve disposed in the nozzle passageway, the fuel valve actuatable to allow a flow of the fuel through the nozzle passageway, a lockout plunger including a longitudinal axis, the lockout plunger having an active configuration allowing actuation of the fuel valve and an inactive configuration preventing actuation of the fuel valve, a rocker arm rotatably supported relative to the nozzle body, the rocker arm rotatable to a stop position maintaining the lockout plunger in the inactive configuration preventing actuation of the fuel valve, and a push rod selectively engageable with the rocker arm, the push rod having a normally biased position in which the push rod engages the rocker arm and maintains the rocker arm in the stop position and an actuated position in which the rocker arm can freely rotate from the stop position, the push rod positioned to be actuated to the actuated position by insertion of the spout into the fuel reservoir, the push rod returning to the normally biased position when the spout is removed from the fuel reservoir, the push rod pulling the rocker arm to the stop position as the push rod returns to the normally biased position when the spout is removed from the fuel reservoir.

In certain embodiments, the fuel dispensing nozzle further comprises an engagement plate moveably connected to the spout, the engagement plate disposed for engagement with a mouth of the fuel reservoir, the engagement plate positioned to actuate the push rod to the actuated position when the engagement plate operatively engages the fuel reservoir to allow the fuel to be conveyed to the fuel reservoir.

In certain embodiments, the fuel dispensing nozzle further comprises a spring, the spring positioned to bias the push rod to the normally biased position.

In certain embodiments, the nozzle body further defines a diaphragm cavity, and the fuel dispensing nozzle further comprises a diaphragm positioned in the diaphragm cavity, the diaphragm actuatable to an active position causing the lockout plunger to maintain the active configuration, the spring positioned outside of the diaphragm cavity.

In certain embodiments, the active configuration of the lockout plunger comprises a stationary configuration of the lockout plunger, and the fuel dispensing nozzle further comprises a nozzle lever pivotable about a pivot extending from the plunger to actuate the fuel valve to allow the flow of the fuel through the nozzle passageway, wherein the inactive configuration of the plunger comprises a moveable configuration of the plunger, whereby the pivot is moveable in the inactive configuration to prevent the nozzle lever from actuating the fuel valve to allow the flow of the fuel through the nozzle passageway.

In certain embodiments, the nozzle body comprises a plurality of passages extending from an exterior of the nozzle body inward, each of the plurality of passages having one of a consistent cross-sectional size throughout a length of the passage and a decreasing cross-sectional size throughout the length of the passage, whereby no buried passages are formed in the nozzle body and whereby, owing to the lack of buried passages, the nozzle body can be die cast, and wherein the fuel dispensing nozzle further comprises a partition selectively securable in at least one of the plurality of passages to fluidly seal a portion of the at least one of the plurality of passages to define a pair of passages, each terminating at the partition, at least one of the pair of passages comprising a buried passage.

In certain embodiments, the spout defines a blind bore formed in a wall of the spout, the blind bore defining an opening in the wall of the spout and running from the opening to a terminal end defined within the wall, the push rod positioned in the blind bore.

In certain embodiments, the rocker arm includes a first end having a cutout between a pair of protrusions, and a first end of the push rod is positioned within the cutout of the rocker arm, the first end of the push rod comprising a bulbous end positionable to bear against the pair of protrusions in the normally biased position of the push rod.

In certain embodiments, the rocker arm further includes a second end, the second end including a first protrusion and a second protrusion separated by a gap, the longitudinal axis of the plunger intersecting the gap between the first protrusion and the second protrusion at the second end of the rocker arm.

According to another exemplary embodiment of the present disclosure, a fuel dispensing nozzle comprises a nozzle body, the nozzle body defining a nozzle body fuel passageway and a diaphragm cavity, a fuel delivery spout extending from the nozzle body, the fuel delivery spout defining a spout fuel passageway, the nozzle body fuel passageway in fluid communication with the spout fuel passageway to form a nozzle passageway capable of conveying a quantity of fuel from a source of the quantity of fuel through the nozzle body and the spout to a fuel reservoir, a fuel valve disposed in the nozzle passageway, the fuel valve actuatable to allow a flow of the fuel through the nozzle passageway, a lockout plunger including a longitudinal axis, the lockout plunger having an active configuration allowing actuation of the fuel valve and an inactive configuration preventing actuation of the fuel valve, a diaphragm positioned in the diaphragm cavity, the diaphragm actuatable to an active position causing the lockout plunger to maintain the active configuration, a rocker arm rotatably supported relative to the nozzle body, the rocker arm rotatable to a stop position preventing the diaphragm from actuating to the active position and thereby maintaining the lockout plunger in the inactive configuration preventing actuation of the fuel valve, a push rod selectively engageable with the rocker arm, and a spring positioned outside of the diaphragm cavity, the spring supplying a spring bias to the push rod to bias the push rod to a normally biased position in which the push rod maintains the rocker arm in the stop position, the push rod transmitting the spring bias of the spring to the rocker arm.

In certain embodiments, the spring is positioned about the push rod.

In certain embodiments, the push rod has an actuated position in which the push rod disengages the rocker arm and the rocker arm can freely rotate from the stop position, the push rod positioned to be actuated to the actuated position by insertion of the spout into the fuel reservoir.

In certain embodiments, the fuel dispensing nozzle further comprises an engagement plate moveably connected to the spout, the engagement plate disposed for engagement with a mouth of the fuel reservoir, the engagement plate positioned to actuate the push rod to the actuated position when the engagement plate operatively engages the fuel reservoir to allow the quantity of fuel to be conveyed to the fuel reservoir.

In certain embodiments, the active configuration of the lockout plunger comprises a stationary configuration of the lockout plunger, and the fuel dispensing nozzle further comprises a nozzle lever pivotable about a pivot extending from the plunger to actuate the fuel valve to allow the flow of the fuel through the nozzle passageway, wherein the inactive configuration of the plunger comprises a moveable configuration of the plunger, whereby the pivot is moveable in the inactive configuration to prevent the nozzle lever from actuating the fuel valve to allow the flow of the fuel through the nozzle passageway.

In certain embodiments, the nozzle body comprises a plurality of passages extending from an exterior of the nozzle body inward, each of the plurality of passages having one of a consistent cross-sectional size throughout a length of the passage and a decreasing cross-sectional size throughout the length of the passage, whereby no buried passages are formed in the nozzle body and whereby, owing to the lack of buried passages, the nozzle body can be die cast, and wherein the fuel dispensing nozzle further comprises a partition selectively securable in at least one of the plurality of passages to fluidly seal a portion of the at least one of the plurality of passages to define a pair of passages, each terminating at the partition, at least one of the pair of passages comprising a buried passage.

In certain embodiments, the spout defines a blind bore formed in a wall of the spout, the blind bore defining an opening in the wall of the spout and running from the opening to a terminal end defined within the wall, the push rod positioned in the blind bore.

In certain embodiments, the rocker arm includes a first end having a cutout between a pair of protrusions, and a first end of the push rod is positioned within the cutout of the rocker arm, the first end of the push rod comprising a bulbous end positionable to bear against the pair of protrusions in the normally biased position of the push rod.

In certain embodiments, the rocker arm further includes a second end, the second end including a first protrusion and a second protrusion separated by a gap, the longitudinal axis of the plunger intersecting the gap between the first protrusion and the second protrusion at the second end of the rocker arm.

According to another exemplary embodiment of the present disclosure, a fuel dispensing nozzle comprises a nozzle body defining a nozzle body fuel passage way, a fuel delivery spout extending from the nozzle body, the fuel delivery spout defining a spout fuel passageway, the nozzle body fuel passageway in fluid communication with the spout fuel passageway to form a nozzle passageway capable of conveying a quantity of fuel from a source of the quantity of fuel through the nozzle body and the spout to a fuel reservoir, an engagement plate moveably connected to the spout, the engagement plate disposed for engagement with a mouth of the fuel reservoir, a fuel valve disposed in the nozzle passageway, the fuel valve actuatable to allow a flow of the fuel through the nozzle passageway, a lockout plunger including a longitudinal axis, the plunger having an active configuration allowing actuation of the fuel valve and an inactive configuration preventing actuation of the fuel valve, and a linkage selectively releasing the lockout plunger from the inactive configuration when the engagement plate is engaged with the mouth of the fuel reservoir, signaling insertion of the spout into the fuel reservoir, the linkage comprising a push rod and a rocker arm pivotable about an axis transverse to the longitudinal axis of the plunger, the push rod having a biased position holding the rocker arm in a no flow position in which the rocker arm maintains the plunger in the inactive configuration to prevent actuation of the fuel valve, the push rod actuated from the biased position when the engagement plate presses against the mouth of the fuel reservoir, the rocker arm rotatable relative to the push rod so that actuation of the push rod from the biased position allows the rocker arm to freely rotate relative to the push rod to allow the plunger plunger to achieve the active configuration to allow actuation of the fuel valve to allow the flow of the fuel through the nozzle passageway.

In certain embodiments, the active configuration of the plunger comprises a stationary configuration of the plunger in which a nozzle lever is pivotable about a pivot extending from the plunger to actuate the fuel valve to allow the flow of the fuel through the nozzle passageway.

In certain embodiments, the inactive configuration of the plunger comprises a moveable configuration of the plunger, whereby the pivot is moveable to prevent the nozzle lever from actuating the fuel valve to allow the flow of the fuel through the nozzle passageway.

In certain embodiments, the nozzle body comprises a plurality of passages extending from an exterior of the nozzle body inward, each of the plurality of passages having one of a consistent cross-sectional size throughout a length of the passage and a decreasing cross-sectional size throughout the length of the passage, whereby no buried passages are formed in the nozzle body and whereby, owing to the lack of buried passages, the nozzle body can be die cast, and wherein the fuel dispensing nozzle further comprises a partition selectively securable in at least one of the plurality of passages to fluidly seal a portion of the at least one of the plurality of passages to define a pair of passages, each terminating at the partition, at least one of the pair of passages comprising a buried passage.

In certain embodiments, the spout defines a blind bore formed in a wall of the spout, the blind bore defining an opening in the wall of the spout and running from the opening to a terminal end defined within the wall.

In certain embodiments, the push rod comprises a first push rod positioned in the blind bore of the fuel delivery spout and a second push rod occupying a passageway in the nozzle body.

In certain embodiments, the rocker arm includes a first end having a cutout between a pair of protrusions, and a first end of the push rod is positioned within the cutout of the rocker arm, the first end of the push rod comprising a bulbous end positionable to bear against the pair of protrusions in the biased position of the push rod.

In certain embodiments, the linkage further includes a catch having a cutout configured to align with the cutout within the first end of the rocker arm, the catch configured to be positioned within an opening of the rocker arm, and the bulbous end of the push rod being positioned within the cutout of the first end of the rocker arm and the cutout of the catch, the bulbous end of the push rod indirectly bearing against the pair of protrusions of the rocker arm, with the catch positioned between the bulbous end of the push rod and the pair of protrusions.

In certain embodiments, the rocker arm further includes a second end, the second end including a first protrusion and a second protrusion separated by a gap, the longitudinal axis of the plunger intersecting the gap between the first protrusion and the second protrusion at the second end of the rocker arm.

According to another exemplary embodiment of the present disclosure, a fuel dispensing nozzle comprises a nozzle body with a liquid fuel delivery spout extending from the nozzle body, the nozzle body defining a nozzle body fuel passageway, the fuel delivery spout defining a spout fuel passageway, the nozzle body fuel passageway in fluid communication with the spout fuel passageway to form a nozzle passageway capable of conveying a quantity of fuel from a source of the quantity of fuel through the nozzle body and the spout to a fuel reservoir, the spout further defining a blind bore formed in a wall of the spout, the blind bore defining an opening in the wall of the spout and running from the opening to a terminal end defined within the wall, a fuel valve disposed in the nozzle passageway, the fuel valve actuatable to allow a flow of the fuel through the nozzle passageway, a lockout plunger including a longitudinal axis, the plunger having an active configuration allowing actuation of the fuel valve and an inactive configuration preventing actuation of the fuel valve, and a linkage selectively releasing the lockout plunger from the inactive configuration when the spout is inserted into the fuel reservoir, the linkage comprising a push rod biased to a no flow position in which the push rod cooperates with the lockout plunger to maintain the inactive configuration of the plunger to prevent actuation of the fuel valve, the push rod actuated from the biased position when the spout is inserted into the fuel reservoir to allow the plunger to achieve the active configuration and allow actuation of the fuel valve to allow the flow of the fuel through the nozzle passageway, the push rod positioned in the blind bore of the fuel delivery spout.

In certain embodiments, the fuel dispensing nozzle further includes an engagement plate moveably connected to the spout, the engagement plate disposed for engagement with a mouth of the fuel reservoir, the engagement plate positioned to actuate the push rod from the biased position when the engagement plate operatively engages the fuel reservoir to allow the fuel to be conveyed to the fuel reservoir.

In certain embodiments, the linkage further comprises a rocker arm pivotable about an axis transverse to the longitudinal axis of the plunger, the push rod, in the no flow position, holding the rocker arm in a rocker arm no flow position in which the rocker arm holds the plunger in the inactive configuration to prevent actuation of the fuel valve, the push rod actuated from the no flow position when the spout is inserted into the fuel reservoir to allow the plunger to achieve the active configuration to allow actuation of the fuel valve to allow the flow of the fuel through the nozzle passageway.

In certain embodiments, the nozzle body comprises a plurality of passages extending from an exterior of the nozzle body inward, each of the plurality of passages decreasing cross-sectional size throughout a length of the passage, whereby no buried passages are formed in the nozzle body and whereby, owing to the lack of buried passages, the nozzle body can be die cast, and wherein the fuel dispensing nozzle further comprises a partition selectively securable in at least one of the plurality of passages to fluidly seal a portion of the at least one of the plurality of passages to define a pair of passages, each terminating at the partition, at least one of the pair of passages comprising a buried passage.

In certain embodiments, the push rod comprises a first push rod positioned in the blind bore of the fuel delivery spout and a second push rod occupying a passageway in the nozzle body.

In certain embodiments, the linkage further comprises a rocker arm pivotable about an axis transverse to the longitudinal axis of the plunger, the second push rod, in the no flow position, holding the rocker arm in a rocker arm no flow position in which the rocker arm holds the plunger in the inactive configuration to prevent actuation of the fuel valve, the second push rod actuated from the no flow position when the spout is inserted into the fuel reservoir to allow the plunger to achieve the active configuration to allow actuation of the fuel valve to allow the flow of the fuel through the nozzle passageway.

In certain embodiments, the push rod extends from the blind bore at the opening in the wall of the spout, and wherein the fuel dispensing nozzle further comprises a linkage cover covering a portion of the push rod extending from the blind bore at the opening in the wall of the spout.

According to another exemplary embodiment of the present disclosure, a fuel dispensing nozzle, comprises a nozzle body including a plurality of passages extending from an exterior of the nozzle body inward, each of the plurality of passages having one of a consistent cross-sectional size throughout a length of the passage and a decreasing cross-sectional size throughout the length of the passage, whereby no buried passages are formed in the nozzle body and whereby, owing to the lack of buried passages, the nozzle body can be die cast, and a partition selectively securable in at least one of the plurality of passages to fluidly seal a portion of the at least one of the plurality of passages to define a pair of passages, each of the pair of passages terminating at the partition, at least one of the pair of passages comprising a buried passage.

In certain embodiments, the fuel dispensing nozzle further includes a retaining ring configured to hold the partition in place.

In certain embodiments, the fuel dispensing nozzle further includes a linkage comprising a rocker arm, the rocker arm being positioned above the partition.

Additional features and advantages of the present invention will become apparent to those skilled in the art upon consideration of the following detailed description of the illustrative embodiments exemplifying the best mode of carrying out the invention as presently perceived.

BRIEF DESCRIPTION OF THE DRAWINGS

The foregoing aspects and many of the intended advantages of this invention will become more readily appreciated as the same becomes better understood by reference to the following detailed description when taken in conjunction with the accompanying drawings.

Figure 1:
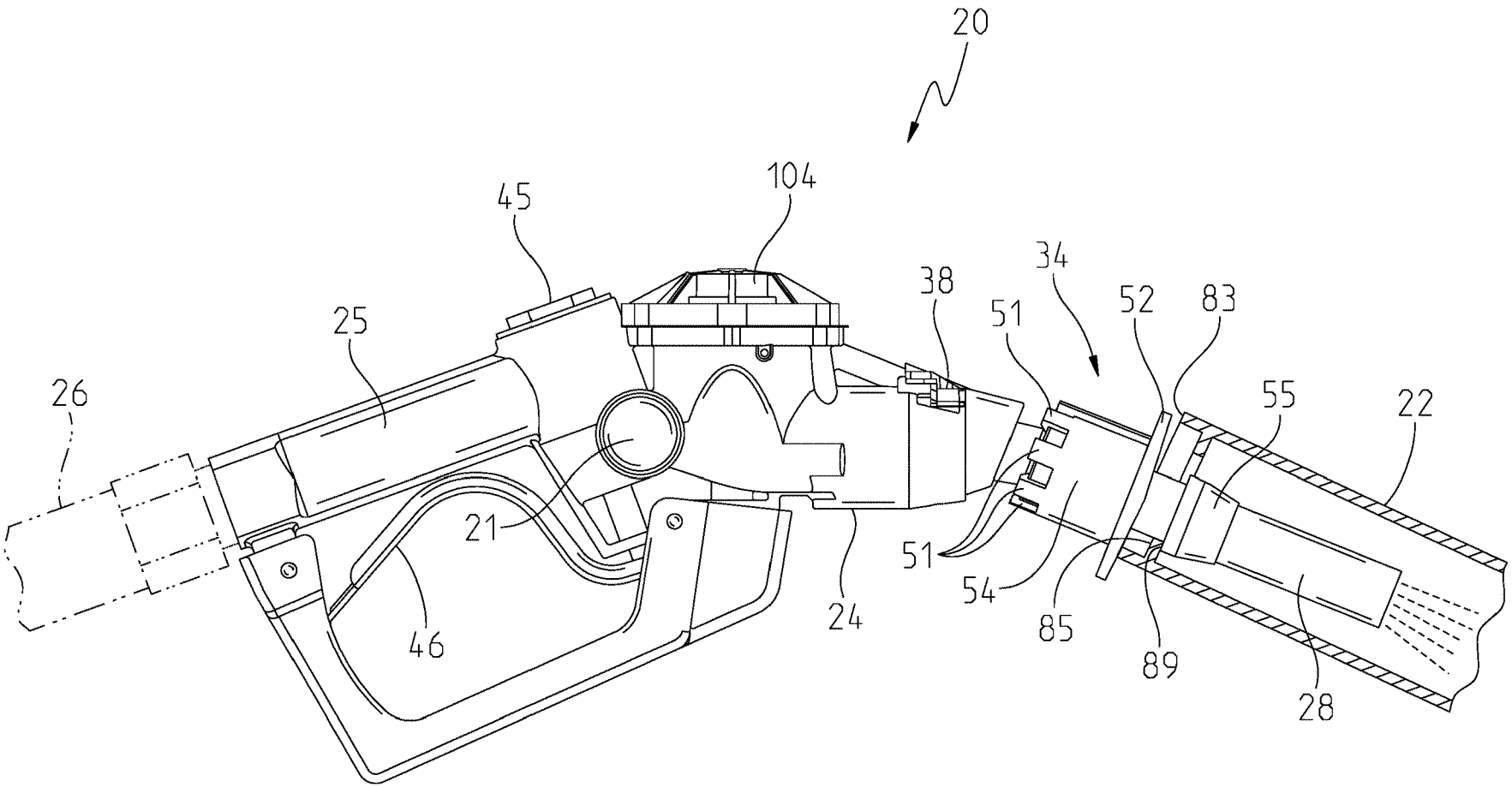
FIG. 1 shows a side view of a fuel dispensing nozzle of the present disclosure in operative contact with a fill pipe of a fuel reservoir.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the invention, and such exemplifications are not to be construed as limiting the scope of the invention in any manner.

DETAILED DESCRIPTION OF THE DRAWINGS

For the purposes of promoting an understanding of the principals of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrative devices and described methods and further applications of the principles of the invention which would normally occur to one skilled in the art to which the invention relates.

Figure 2:
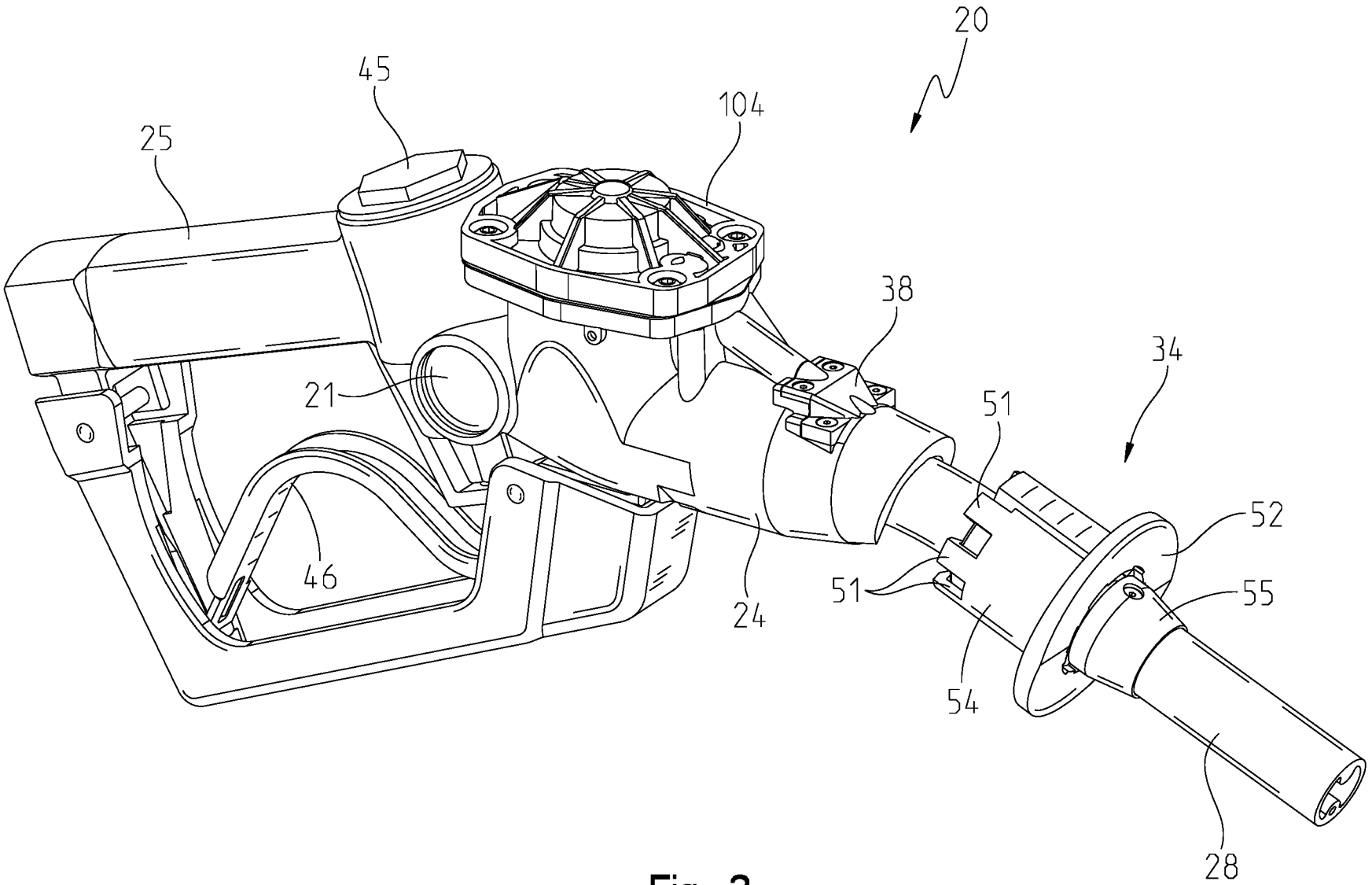
FIG. 2 shows a front perspective view of the fuel dispensing nozzle of FIG. 1.
Figure 3:
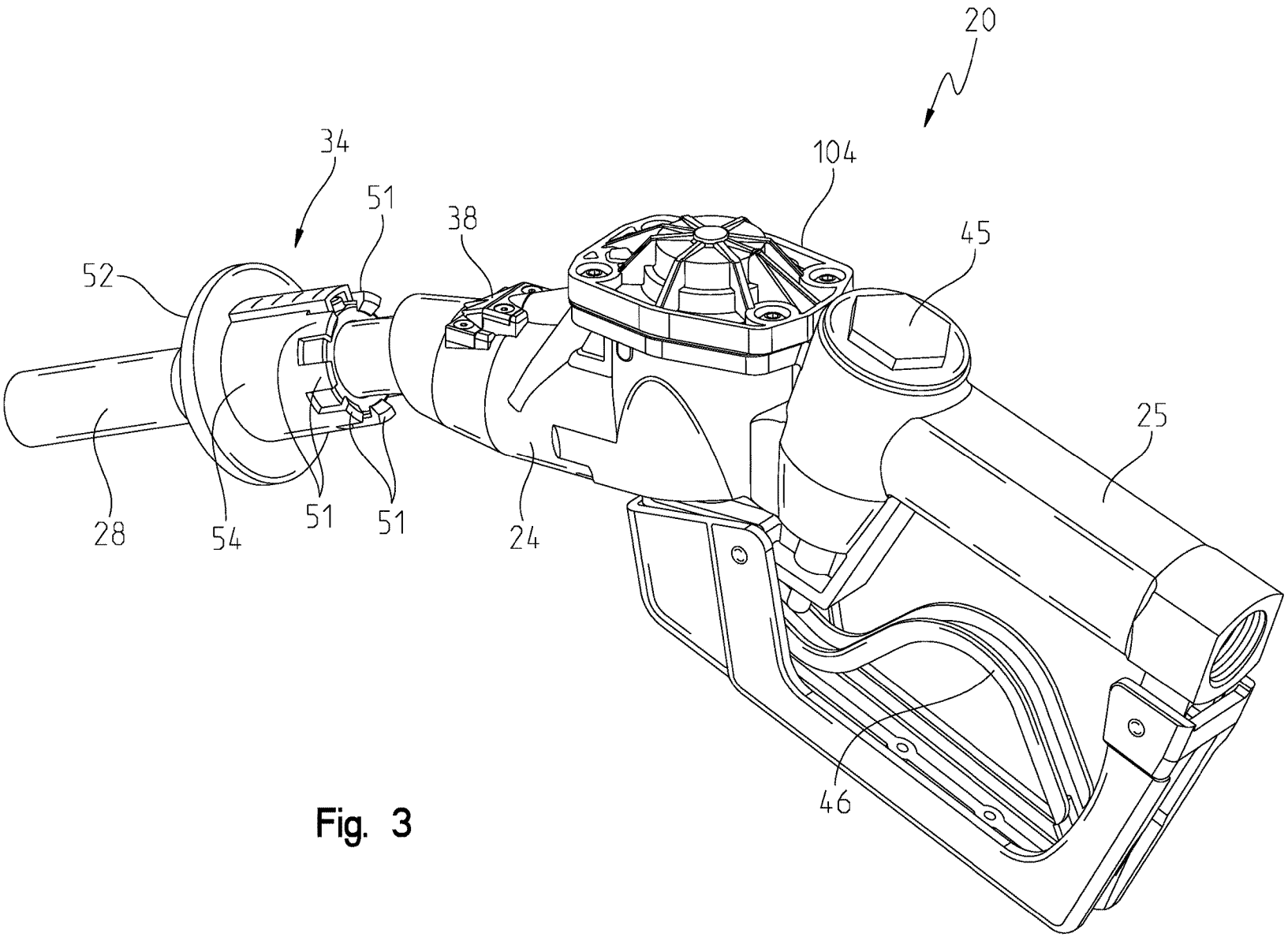
FIG. 3 shows a rear perspective view of the fuel dispensing nozzle of FIG. 1.

Referring initially to FIGS. 1-3, fuel dispensing nozzle 20 is shown for delivery of liquid fuel from a dispenser or other source of fuel to fill pipe or inlet 22 of a fuel tank or fuel container. Fuel dispensing nozzle 20 generally includes nozzle body 24, formed, e.g., of aluminum, connected to the dispenser by fuel hose 26 (FIG. 1). Nozzle body 24 is coupled to nozzle spout 28. Nozzle body 24 and nozzle spout 28 together define a passageway P (FIGS. 6, 7, and 8) for flow of liquid fuel from the fuel dispenser, through fuel hose 26 and passageway P of nozzle body 24 and nozzle spout 28, into fill pipe 22. In various embodiments, nozzle body 24 includes a plurality of conduits or openings, including portions of passageway P, none of which are buried, such that nozzle body 24 may be die-cast. More specifically, nozzle body 24 includes a plurality of conduits or openings cast by inserting a tool along each of trajectories $T_1$-$T_4$ and withdrawing the tool once the casting is complete (FIG. 4) such that each conduit or opening either has a consistent cross-sectional size throughout its length or a decreasing cross-sectional size throughout its length. Nozzle body 24 is capable of being die-cast because the conduits or openings formed along trajectories $T_1$-$T_4$ do not expand along each respective trajectory, but rather narrow. When nozzle body 24 is die-cast, removable or selectively securable partition 23 (FIGS. 6-8) has a generally annular shape (FIG. 9) and is positioned within nozzle body 24 to separate fuel passage P from other conduits or openings of nozzle body 24, and includes seal 19 (FIG. 6A) that seals passage P from other conduits or openings of nozzle body 24. Removable partition 23 allows for the creation of a buried passage, i.e., a passage terminating at partition 23 that could not be created by the exterior to interior insertion of a tool along trajectory $T_2$ if the partition was integral to the nozzle body. Rather, partition 23 is placed into nozzle body 24 after the die-casting process is completed, and held in place within nozzle body 24 by retaining ring 27 (FIG. 6A). In various embodiments, the buried passage is a portion of fuel passageway P. In addition, in the exemplification shown, nozzle body 24 includes a plurality of covers (e.g., passageway cover 21, linkage cover 38, main valve cover 45, and top cover 104 (FIG. 1)) coupled to the die-cast portion of nozzle body 24 for sealing the passageway P, lockout assembly 32, main fuel valve 30, and linkage mechanism 36 (FIGS. 6-8) within nozzle body 24 and spout 28. In other various embodiments, nozzle body 24' may be formed of a single integral piece such that a structure analougous to partition 23 is integrally, monolithically formed as a single piece together with nozzle body 24', and passageway cover 21 is unnecessary (see FIGS. 14 and 15).

Referring to FIGS. 4 and 6-8, the flow of fuel through passageway P is controlled by main fuel valve 30 (FIG. 6) mounted within main fuel valve opening 3929 (FIG. 4) of nozzle body 24 at upper end 41 of valve stem 40. Valve stem 40 is mounted for axial movement within nozzle body 24, with valve stem seal 42 sealing valve stem 40 relative to nozzle body 24. Main valve spring 44 urges main fuel valve 30 closed. Main fuel valve 30 is opened by squeezing or lifting operating lever 46 toward handle 25 of nozzle body 24, causing operating lever 46 to pivot about axis, A, of lever pin 47, which rotatably secures operating lever 46 to outer end 49 of plunger 48. Plunger 48 extends in telescoping relationship from lower rod 50 of lockout assembly 32. As operating lever 46 pivots, it engages (and lifts) exposed end 43 of valve stem 40 in a manner to actuate (open) main fuel valve 30, subject to other conditions, as will be discussed below.

With reference to FIGS. 1-8, fuel dispensing nozzle 20 includes lockout assembly 32 (FIG. 6) positioned within lockout assembly openings 31, 33 (FIG. 4) of nozzle body 24, engagement assembly 34 surrounding nozzle spout 28, and linkage mechanism 36, coupling engagement assembly 34 to lockout assembly 32, all of which cooperate to prevent main fuel valve 30 from opening when nozzle 20 is not engaged with fill pipe 22 and to allow main fuel valve 30 to open when nozzle 20 is positioned with spout 28 positioned in fill pipe 22.

Figure 5:
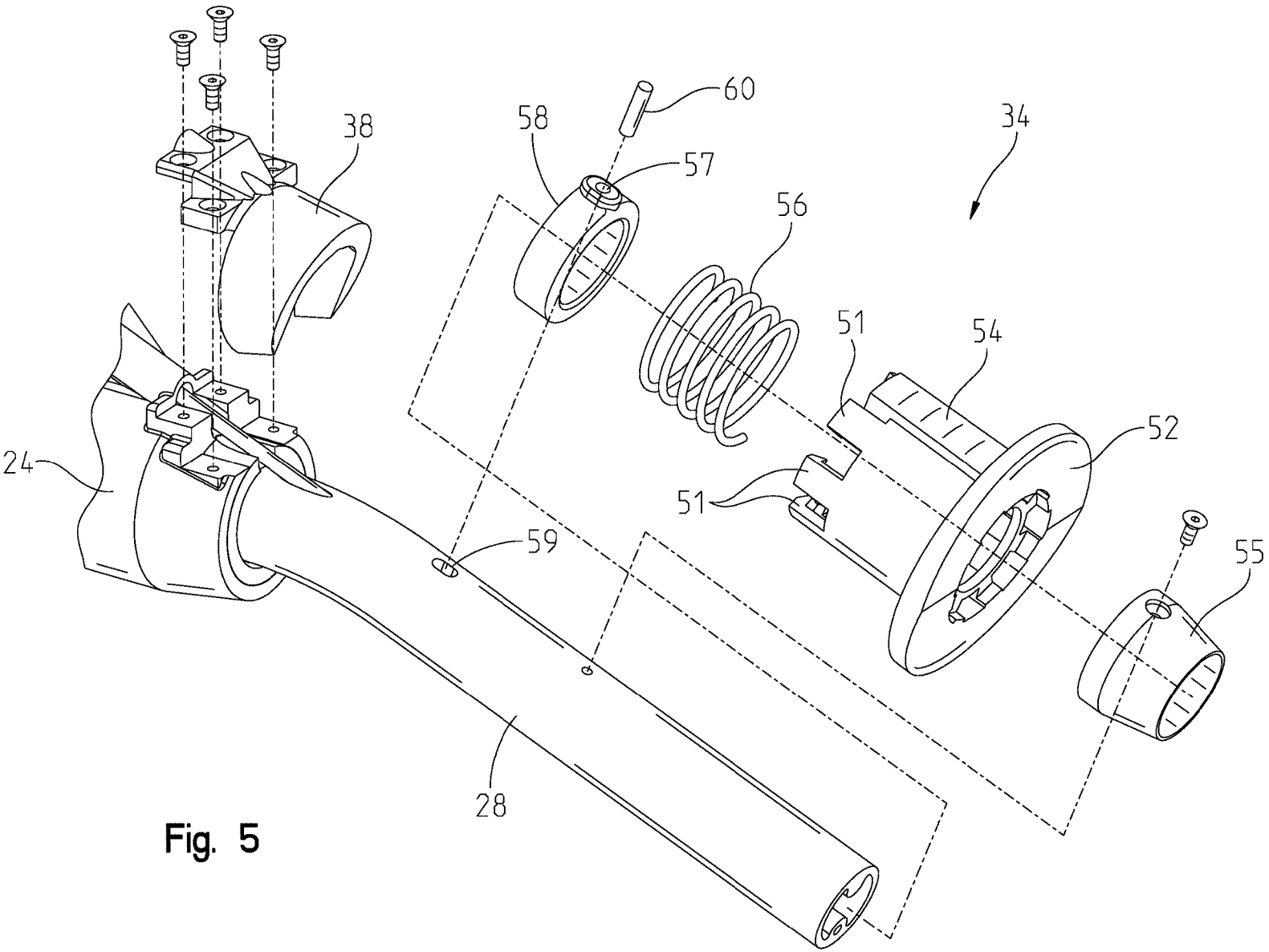
FIG. 5 shows an exploded perspective view of an engagement assembly, a nozzle spout, and a linkage cover of the fuel dispensing nozzle of FIG. 1.

Referring now to FIGS. 5-8, engagement assembly 34, surrounding nozzle spout 28, generally includes engagement plate 52, shiftable sleeve 54, tapered lock protrusion 55, spring 56, translation ring 58, and connecting push pin 60. For the purposes of this document, "plate" is not limited to a flat surface of uniform thickness, but rather is meant to encompass elements having opposing surfaces capable of receiving and transferring force. Connecting push pin 60 extends through opening 57 within translation ring 58 (FIG. 5) and into elongated opening 59 in nozzle spout 28. When nozzle spout 28 is inserted in fill pipe 22, engagement plate 52 engages against fill pipe 22 (FIG. 1). Pressure on engagement plate 52 serves to displace engagement plate 52 and sleeve 54 axially along spout 28 towards nozzle body 24 such that protrusion 85 of fill pipe 22 can catch on tapered lock protrusion 55 positioned about nozzle spout 28 to support nozzle 20, as shown in FIG. 1. Spring 56 is positioned between plate 52 and translation ring 58 such that the displacement of sleeve 54 and plate 52 is communicated by spring 56 to translation ring 58 and connecting push pin 60 causing connecting push pin 60 to shift in elongated opening 59 (FIG. 5). The displacement of connecting push pin 60 is then communicated to lockout assembly 32 through linkage mechanism 36, as further described below.

In various embodiments, connecting push pin 60, translation ring 58, and spring 56 cooperate so that push pin 60 and translation ring 58 translate only a portion of the distance displaced by sleeve 54 and engagement plate 52 to push pin 60, with the additional displacement of sleeve 54 and plate 52 taken up by spring 56. Furthermore, in various embodiments, engagement plate 52 is crowned or capable of pivoting in order for fuel nozzle 20 to accommodate all types of fill pipes. To further accommodate all types of fill pipes, an inner diameter of engagement assembly 34 can be larger than an outer diameter of spout 28 such that engagement assembly 34 as a whole is capable of rocking about spout 28. In addition, in various embodiments, shiftable sleeve 54 has a plurality of fingers 51 (FIG. 5), on an end opposite the engagement plate 52, that contain translation ring 58 and spring 56 and keep spring 56 from pushing translation ring 58 and connecting push pin 60 to an engaged position when engagement assembly 34 is not engaged. Specifically, fingers 51 may flex outwardly to accommodate passage of translation ring 58 when assembling nozzle 20. In other various embodiments, shiftable sleeve 54 may be a two-piece assembly configured to contain spring 56 and translation ring 58.

Referring now to FIGS. 6-9, linkage mechanism 36 generally includes lower push rod 62, upper push rod 64, rocker arm 66, upper push rod catch 68, and spring 69. In this document, "spring" is used in its normal sense to denote any elastic contrivance or body. First end 61 of lower push rod 62, extending into blind bore 70 (FIG. 6) within nozzle spout 28, abuts connecting push pin 60 such that lower push rod 62 is displaced towards nozzle body 24 when connecting push pin 60 is similarly displaced. Throughout this document, the term "rod" is used to denote a rigid structure having no appreciable compressibility on a macro (i.e., non-microscopic) level. Blind bore 70 extends from an opening in a wall of spout 28 and terminates at a terminal end defined within the wall of spout 28. Elongated opening 59 (FIG. 5) may intersect blind bore 70. In various embodiments, blind bore 70 is machined using a tool inserted into the wall of spout 28 and removed prior to reaching a distal end of spout 28.

Second end 63 of lower push rod 62, extending into bore 72 within nozzle body 24, abuts first end 65 of upper push rod 64. Upper push rod 64, extending within bore 72 of nozzle body 24 (FIGS. 4 and 6A), is displaced towards lockout assembly 32 when lower push rod 62 and connecting push pin 60 are similarly displaced. To effect such displacement, spring 56 is more resistant to compression than is spring 69. The portion of lower push rod 62 extending between nozzle body 24 and spout 28 may be concealed by linkage cover 38 coupled to an outer surface of nozzle body 24, such that the entire linkage mechanism 36 is concealed by nozzle body 24, spout 28, and linkage cover 38. In various embodiments, upper push rod 64 and lower push rod 62 are formed as a single integral, monolithic piece extending between rocker arm 66 and connecting push pin 60.

Figure 12:
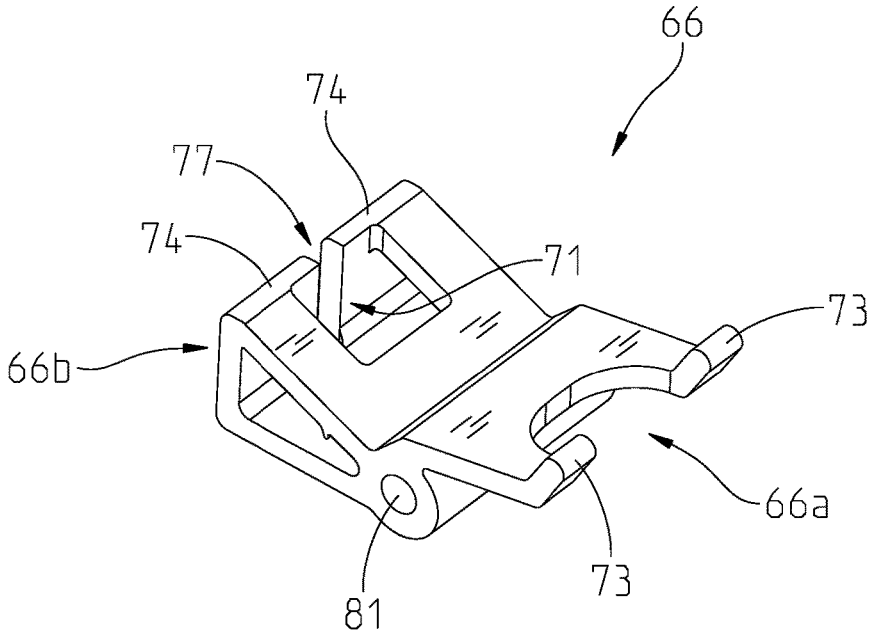
FIG. 12 shows a perspective view of a rocker arm of a linkage mechanism of the fuel dispensing nozzle of FIG. 1.
Figure 13:
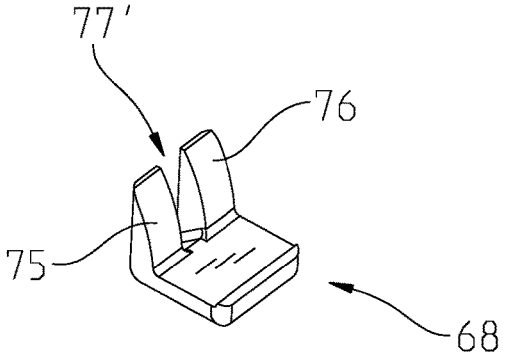
FIG. 13 shows a perspective view of an upper push rod catch of a linkage mechanism of the fuel dispensing nozzle of FIG. 1.

Referring to FIGS. 6-10 and 12, at the end of bore 72 (FIG. 6A), rocker arm 66 is positioned within lockout assembly opening 31 above partition 23 (FIG. 4) such that displacement of upper push rod 64 allows rocker arm 66 to pivot about an axis transverse to a longitudinal axis of plunger 48 such that spring 100 can translate spacer 94 of lockout assembly 32 downward to allow lockout assembly 32 to transition into an engaged position, as further described below. Rocker arm 66 is pivotably coupled within lockout assembly opening 31 (FIG. 4) via rod or pin 79 (FIG. 10) that extends from one side of nozzle body 24 to the other side of nozzle body 24 and through passage 81 (FIG. 12) in rocker arm 66. Referring to FIG. 12, rocker arm 66 includes first end 66*a* and second end 66*b*. First end 66*a* includes at least two arms or protrusions 73, and second end 66*b* includes protrusions 74, with cutout 77 therebetween. In various embodiments, rocker arm 66 is metallic and houses upper push rod catch 68 (FIG. 13), which is made of plastic. Upper push rod catch 68 is made of plastic to reduce friction between upper push rod 64 and rocker arm 66. Upper push rod catch 68 is positioned within cutout or opening 71 (FIG. 12) of rocker arm 66 such that cutout 77' within catch 68 is aligned with cutout 77 of rocker arm 66. Enlarged or bulbous second end 67 of upper push rod 64 is positioned within cutout 77 (FIG. 12) between protrusions 74 of rocker arm 66 and cutout 77' (FIG. 13) between first and second legs 75, 76 of catch 68 such that enlarged end 67 of upper push rod 64 may engage catch 68 and hold rocker arm 66 in a disengaged or no flow position (FIGS. 6 and 6A), or translate away from cutouts 77, 77' and catch 68 to allow rocker arm 66 to freely rotate relative to push rod 64 to an engaged position (illustrated in FIG. 7). Rocker arm 66 is freely rotatable in that only the friction of the rotatable connection resists its rotation. In other various embodiments, rocker arm 66 may be made of plastic and upper push rod catch 68 may be unnecessary.

Figure 4:
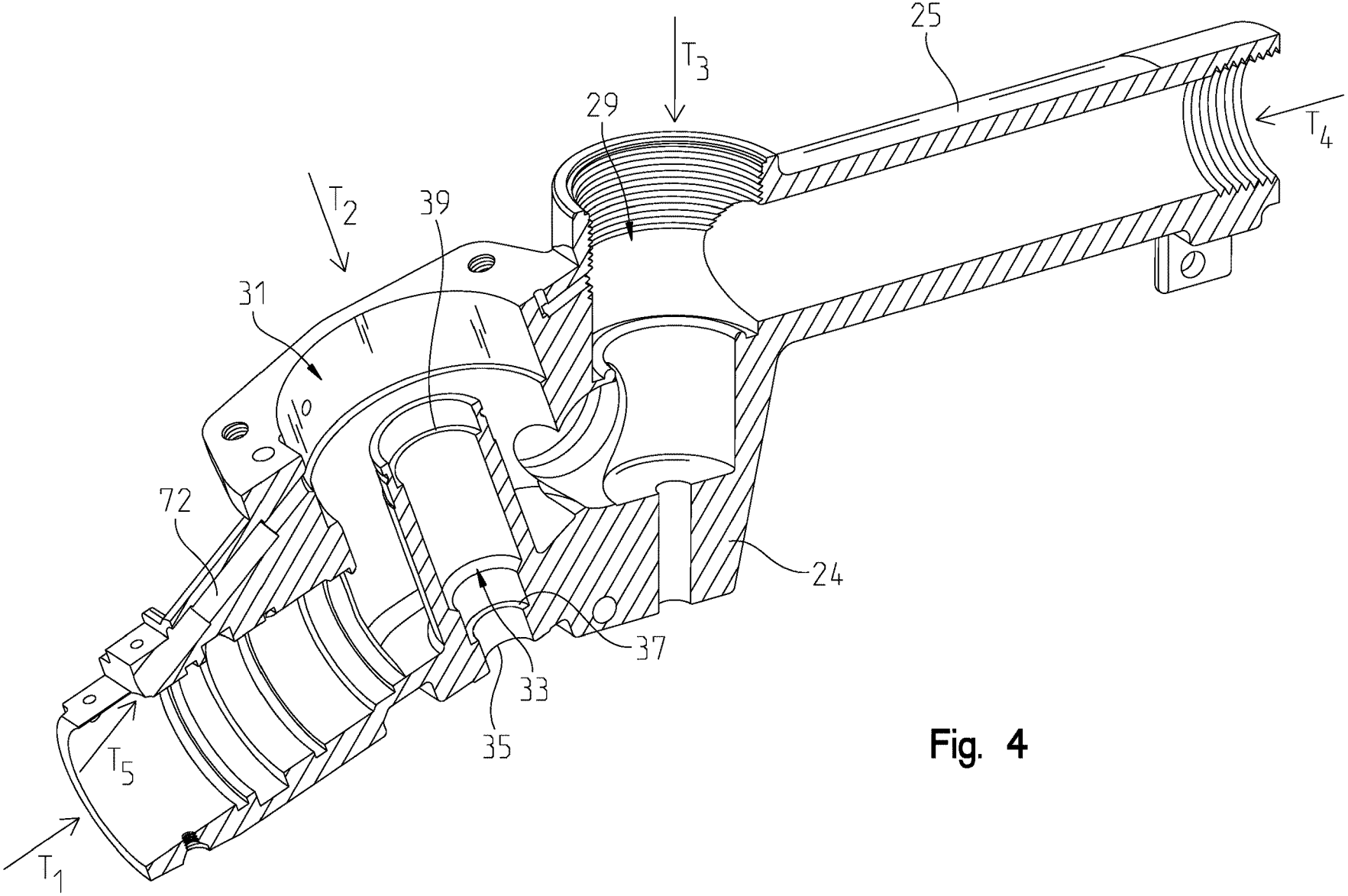
FIG. 4 shows a perspective, cross sectional view of a nozzle body of the fuel dispensing nozzle of FIG. 1.

With reference to FIGS. 6-9, lockout assembly 32 generally includes piston 78 (FIG. 6A), plunger 48, diaphragm 80, and tapered body 82 (FIG. 6A). Plunger 48, slideably disposed in lockout assembly opening 33 (FIG. 4), has its outer end 49 extending from nozzle body 24 (FIG. 6) through first end 35 of lockout assembly opening 33 (FIG. 4). Plunger latch spring 84 (FIG. 6A) extends within lockout assembly opening 33 between shoulder 37 (FIG. 4) of lockout assembly opening 33 where it narrows from a middle region to a lower region and flange 87 of plunger 48 (FIG. 6A), such that spring 84 urges plunger 48 upwardly in lockout assembly opening 33. A number of balls 86, e.g. three, are disposed in ball chambers 88 of plunger 48 and arrayed about lockout assembly 32. Latch ring 90, engaged with shoulder 39 (FIG. 4) of lockout assembly opening 33 where it narrows from an upper region to a middle region, has a sloped inner surface that directs balls 86 inwardly, towards the surface of plunger 48.

Still referring to FIGS. 6-9, lockout assembly 32 also includes lower rod 50, which is disposed in co-axial, sliding, telescoping relationship with plunger 48. The upper end of lower rod 50 is engaged with tapered body 82, which in turn is engaged with spacer 94. Lift nut 96, disposed at the upper surface of washer 98, is in threaded engagement with the upper end of tapered body 82, which extends through washer 98, diaphragm 80, and spacer 94 of lockout assembly 32. Lockout assembly 32 further includes compression spring 100, disposed in chamber 102. Chamber 102 is defined between an upper surface of diaphragm 80 and a bottom surface of piston 78 of lockout assembly 32. Compression spring 100 is engaged between piston 78 and washer 98, and aids in positioning tapered body 82 and diaphragm 80 at rest or in a disengaged configuration.

Figure 6:
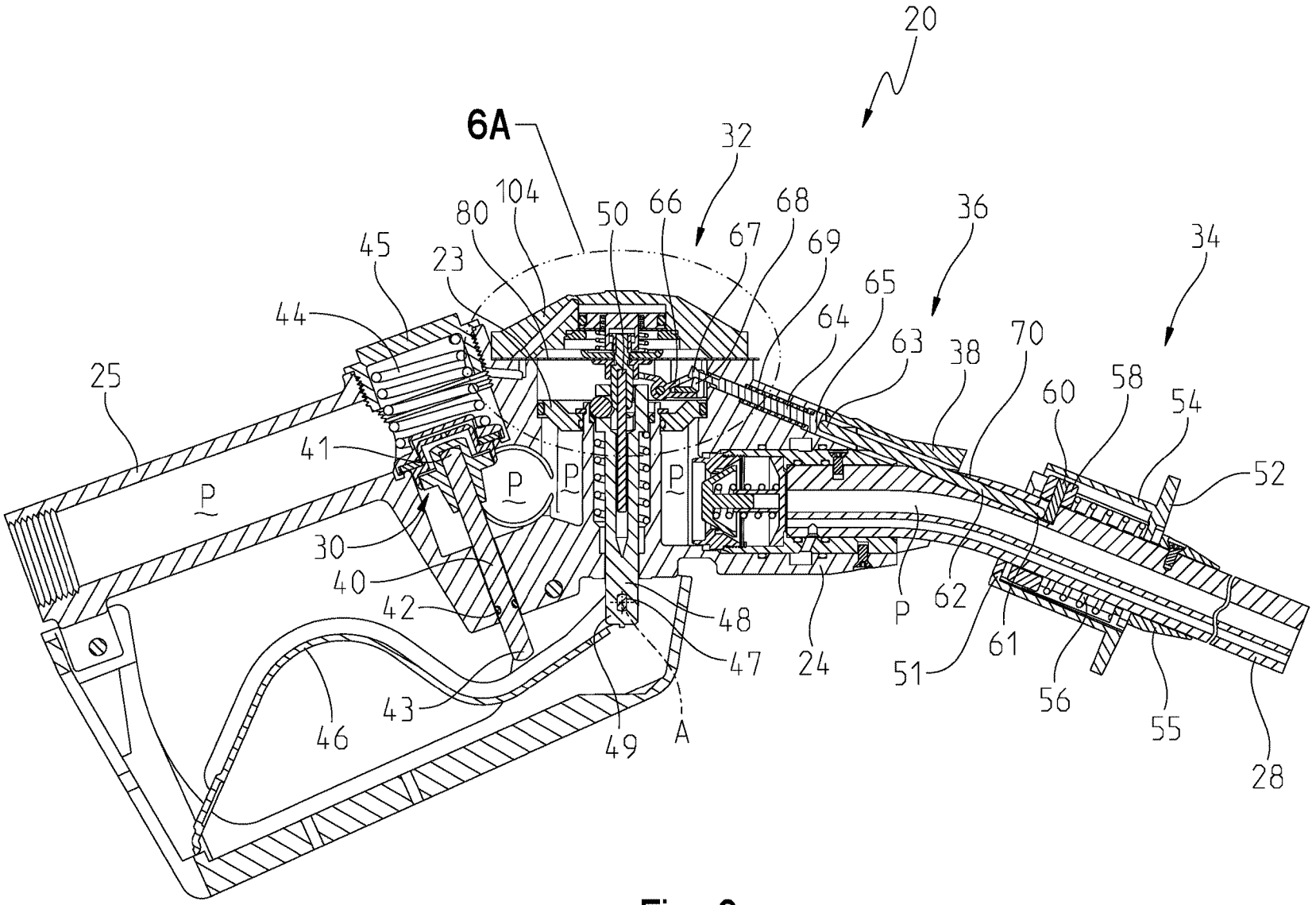
FIG. 6 shows a cross-sectional view of the fuel dispensing nozzle of FIG. 1 in a disengaged configuration with a lever of the fuel dispensing nozzle in a disengaged position.
Figure 6A:
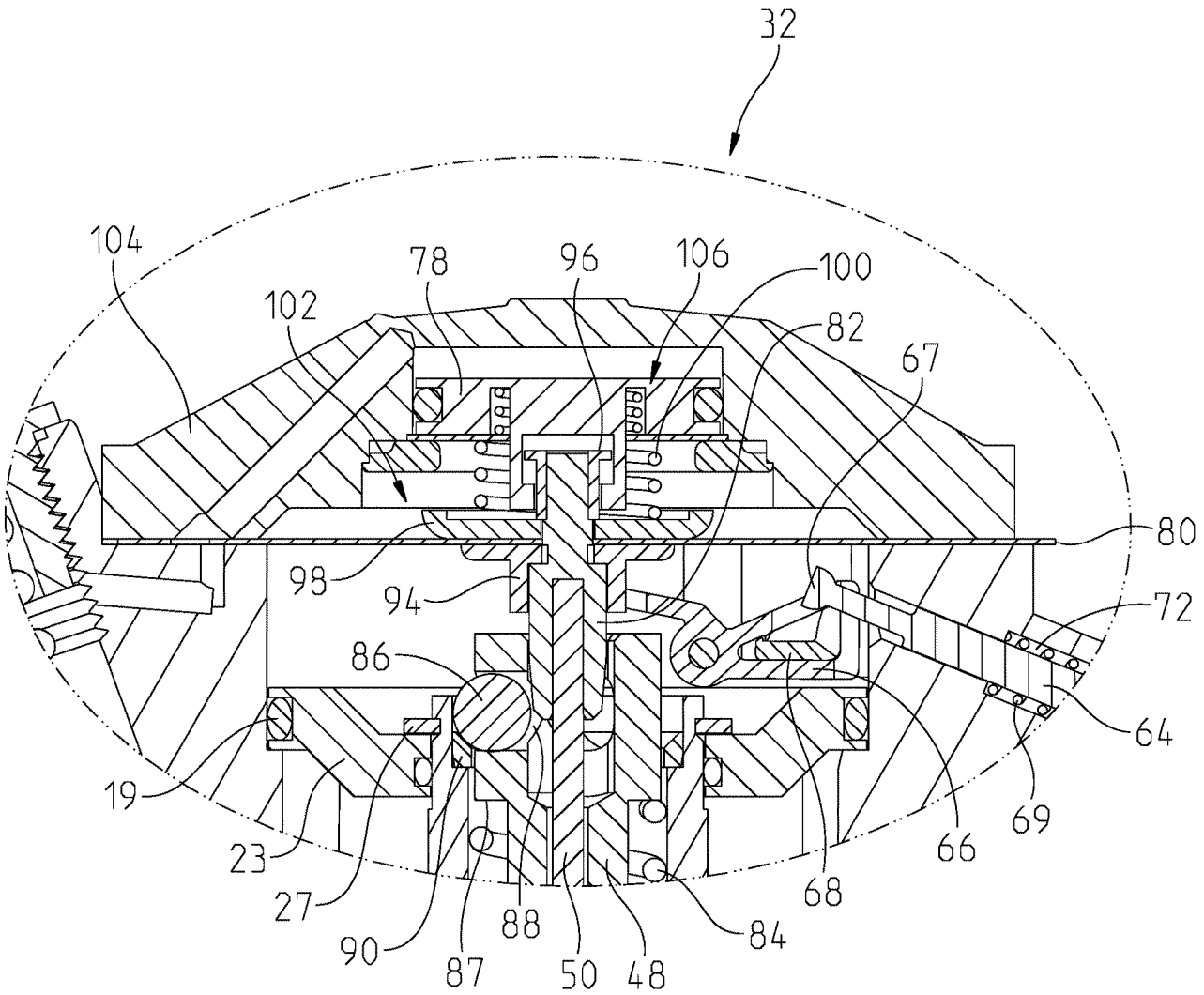
FIG. 6A shows a detailed view of the circled area identified as 6A in FIG. 6.
Figure 7:
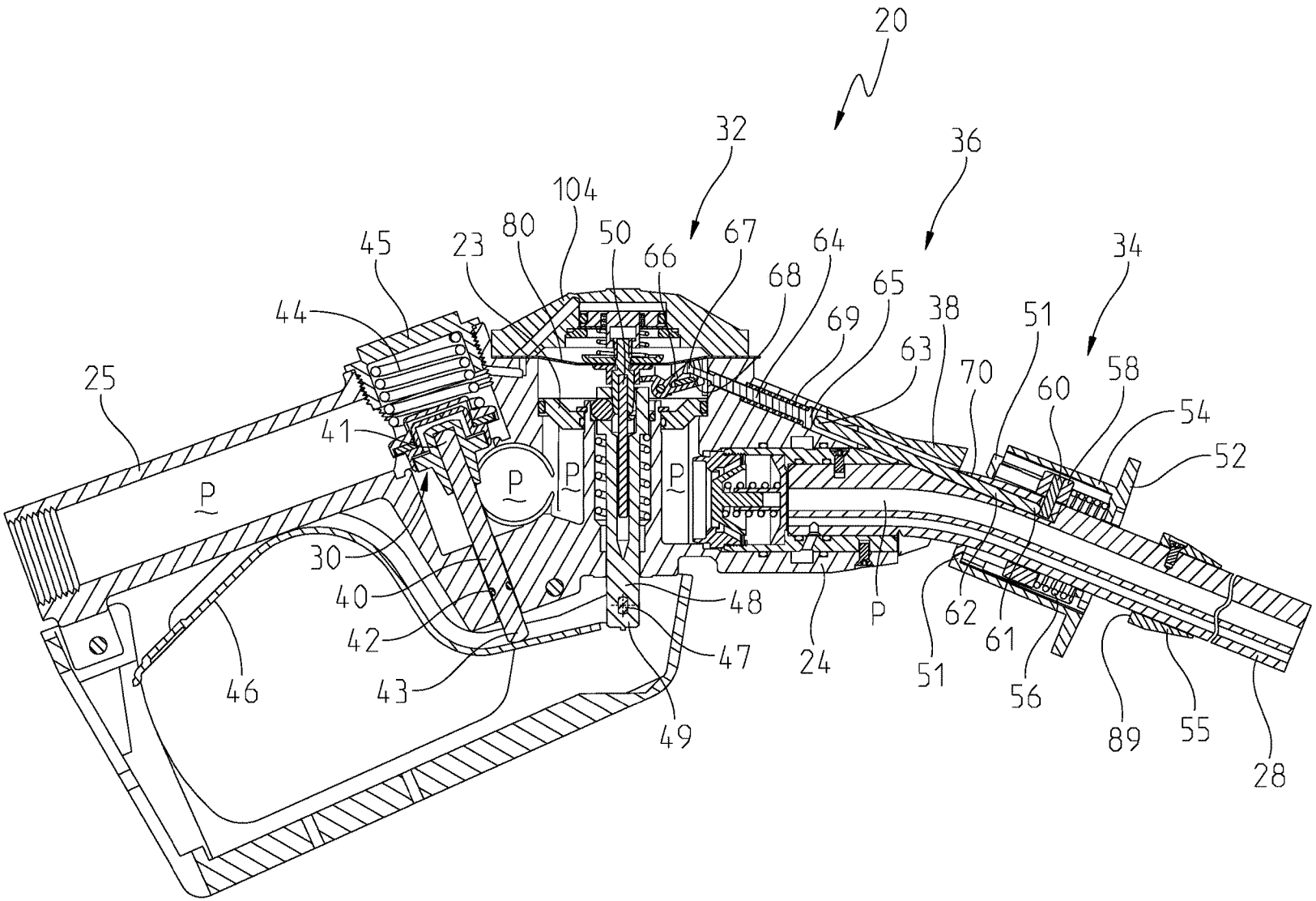
FIG. 7 shows a cross-sectional view of the fuel dispensing nozzle of FIG. 1 in an engaged configuration with a lever of the fuel dispensing nozzle in an engaged position to allow a flow of fuel through the nozzle.
Figure 8:
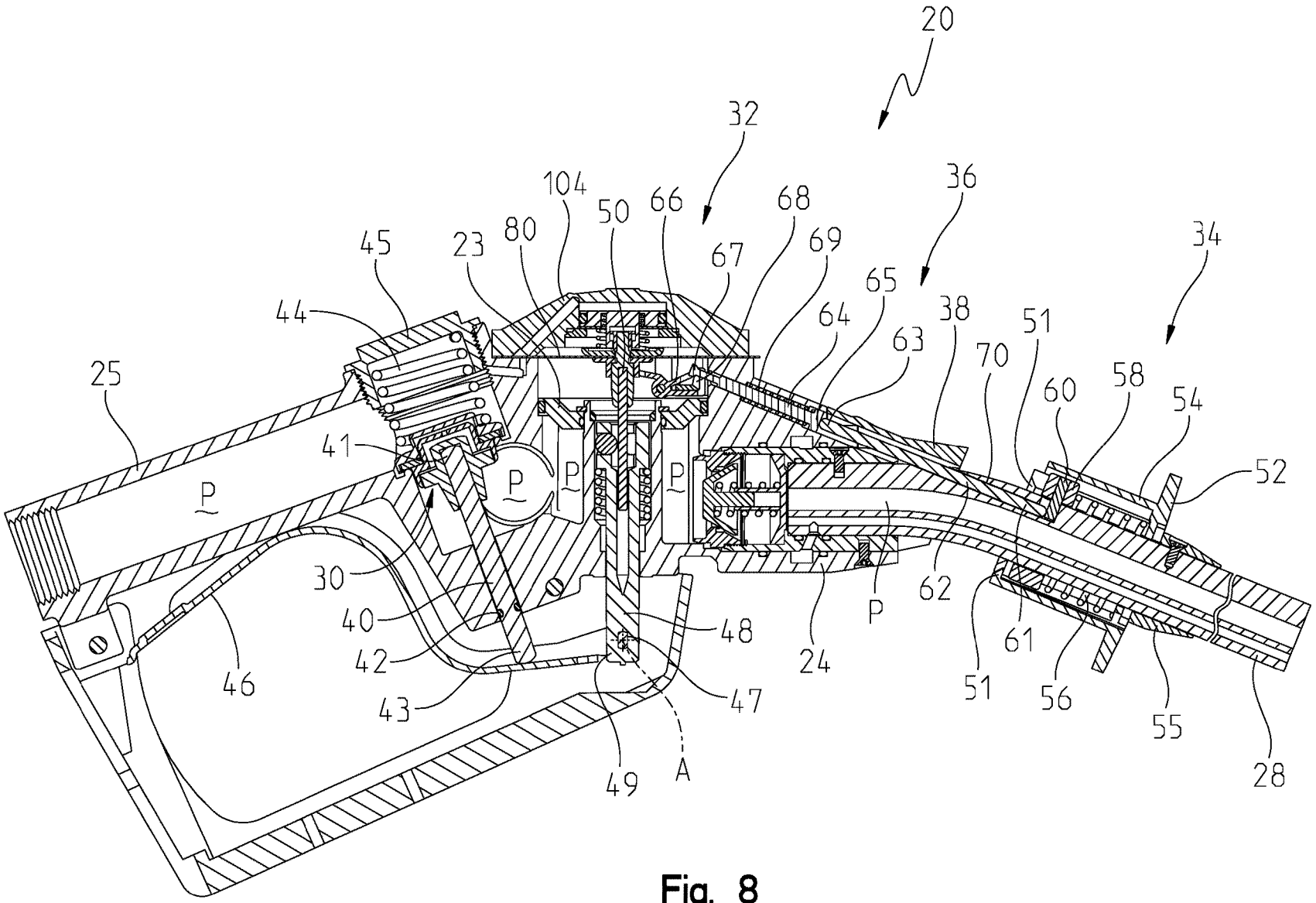
FIG. 8 shows a cross-sectional view of the fuel dispensing nozzle of FIG. 6 with the lever in an engaged position but with a lockout assembly unactuated so that the flow of fuel is disallowed.
Figure 9:
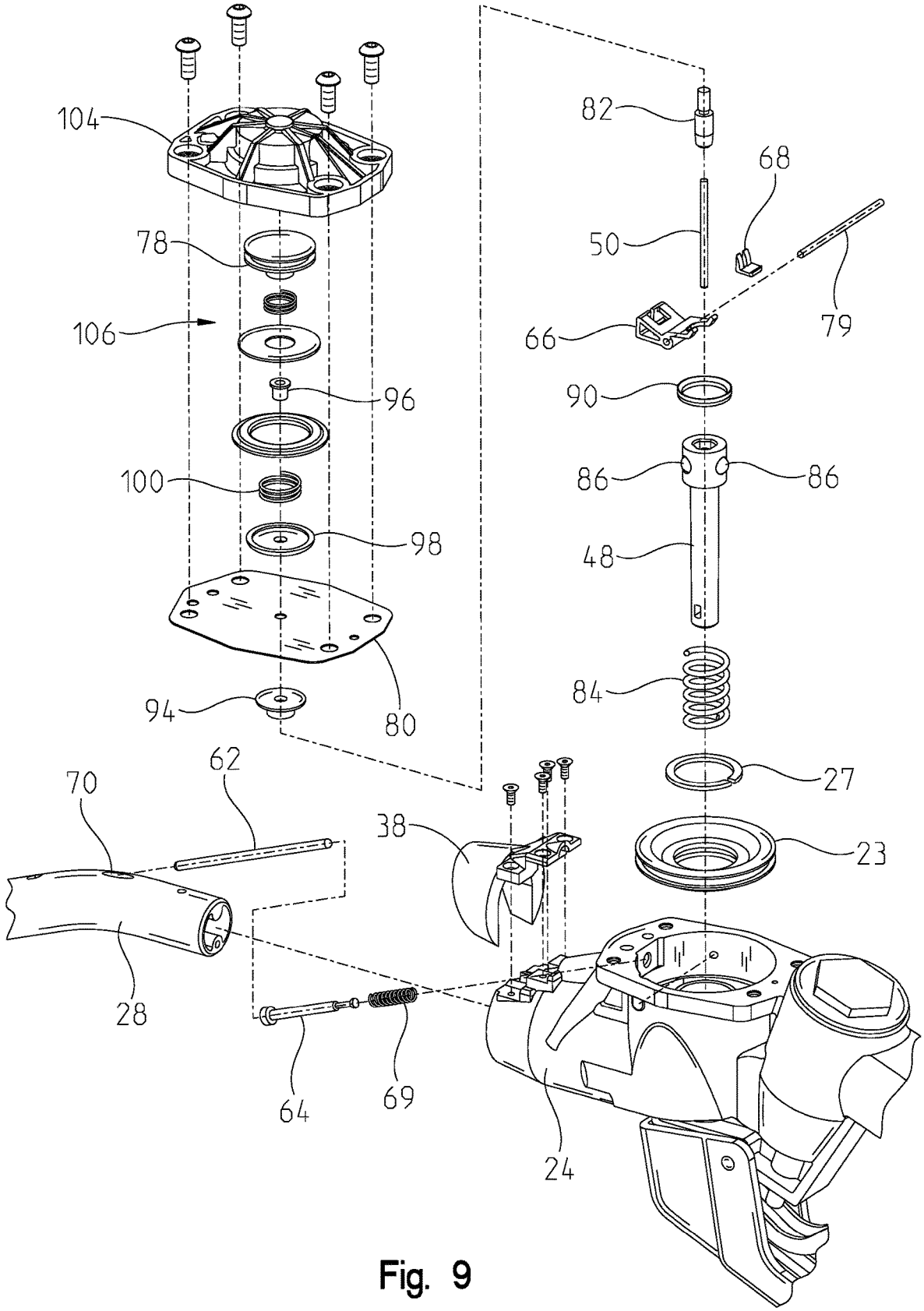
FIG. 9 shows an exploded perspective view of a lockout assembly, a linkage mechanism, a nozzle spout, and a linkage cover of the fuel dispensing nozzle of FIG. 1.
Figure 10:
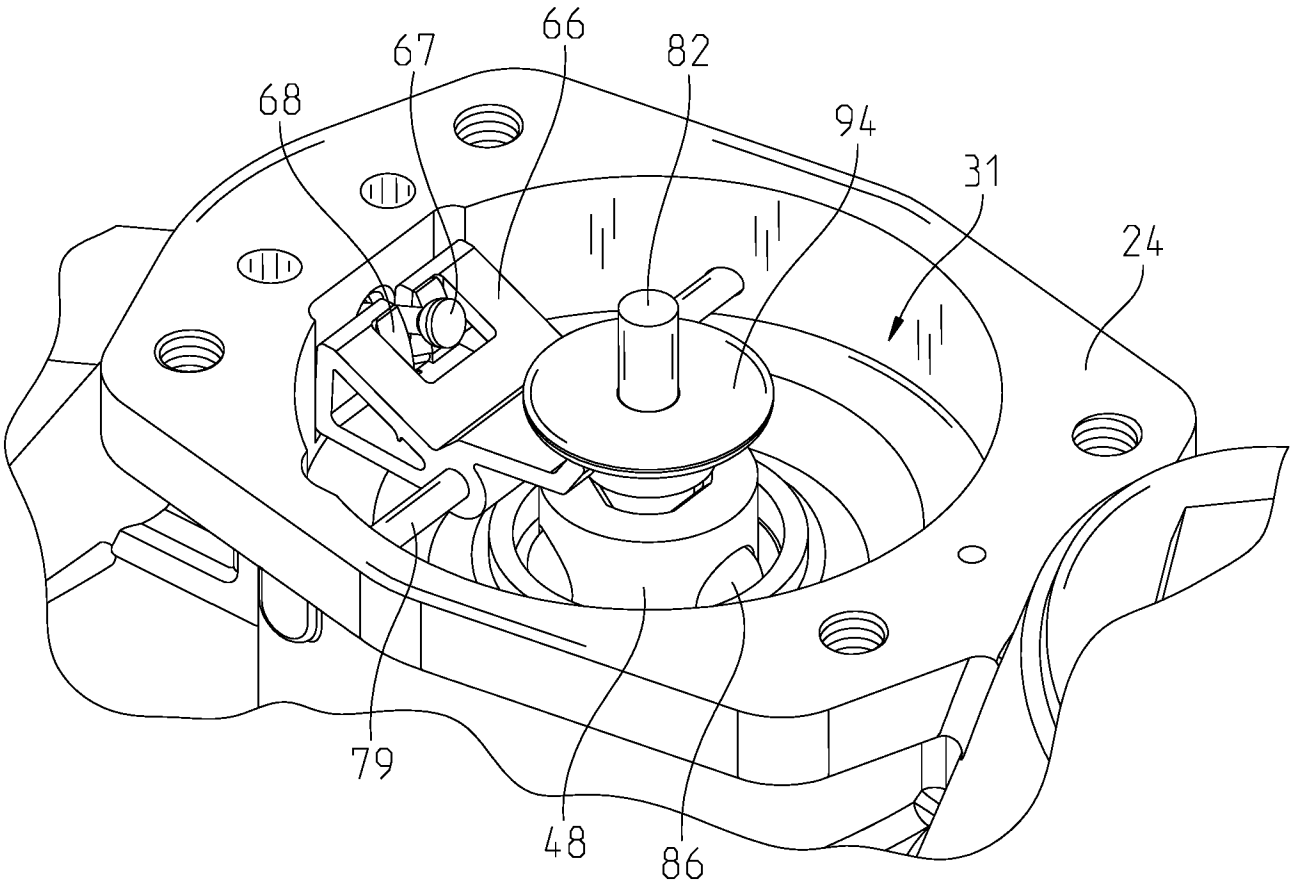
FIG. 10 shows a top perspective view of a portion of a lockout assembly within a nozzle body of the fuel dispensing nozzle of FIG. 1.
Figure 11:
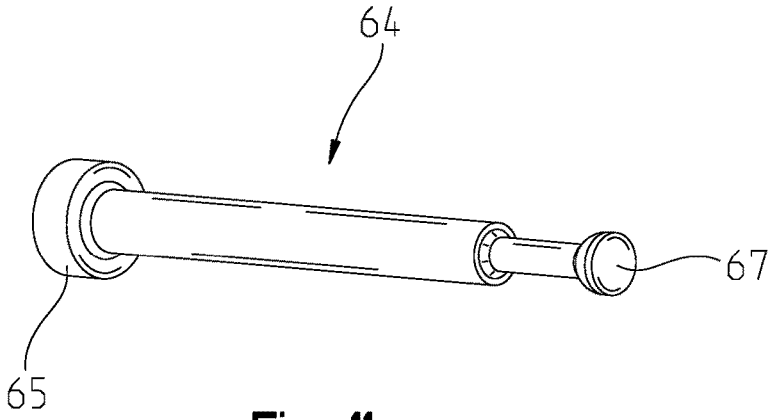
FIG. 11 shows a perspective view of an upper push rod of a linkage mechanism of the fuel dispensing nozzle of FIG. 1.

Referring still to FIGS. 6-8, when tapered body 82 of lockout assembly 32 is in a lowered or engaged position (FIG. 7), balls 86 in ball chambers 88 are in latching engagement between latch ring 90 and the opposed surface of tapered body 82, securing the position of balls 86, ball chambers 88, and attached plunger 48. With tapered body 82 engaged upon balls 86, plunger 48 is fixed axially relative to nozzle body 24 which permits actuation of main fuel valve 30. In this position, squeezing pressure applied against operating lever 46 acts to lift valve stem 40 to open main fuel valve 30, because pivot lever pin 47 is effectively immobile and provides a stationary fulcrum about which lever 46 rotates to apply pressure to valve stem 40.

With reference now to FIGS. 6, 6A, and 8, when fuel dispensing nozzle 20 is not engaged with fill pipe 22 (FIG. 1) of a vehicle or container, nozzle 20 is considered to be in a disengaged or inactive configuration. When nozzle 20 is in the disengaged configuration, the bias of spring 69 pushes upper push rod 64, lower push rod 62, connecting push pin 60, sleeve 54, spring 56, and engagement plate 52 axially along spout 28 away from nozzle body 24 such that engagement plate 52 abuts tapered lock protrusion 55. When upper push rod 64 is biased to the disengaged, no flow, or biased position, rocker arm 66 and catch 68 are held in a disengaged position, where protrusions 74 of second end 66*b* of rocker arm 66 are positioned adjacent nozzle body 24. When rocker arm 66 is held in (i.e., pulled to) the disengaged position, first end 66*a* of rocker arm 66 engages spacer 94 and holds lockout assembly 32 upward in a disengaged position. In various embodiments, when rocker arm 66 engages spacer 94, one of protrusions 73 of rocker arm 66 is on a first side of plunger 48, while the other of protrusions 73 is positioned on a second side of plunger 48. When lockout assembly 32 is in a disengaged position, compression spring 100 is compressed and diaphragm 80 and tapered body 82 are translated upward to a disengaged position. When tapered body 82 is translated upward in a disengaged position, balls 86 are disposed in ball chambers 88 and plunger 48 is in a moveable configuration and capable of translating freely downward relative to nozzle body 24A. In this condition, when pressure is applied to lever 46, this pressure pulls plunger 48 downward rather than overcoming the biasing force of valve spring 44, such that the pressure cannot be transferred to valve stem 40 in sufficient amount to actuate main fuel valve 30. and the delivery of fuel is therefore prevented. Instead, pressure applied to lever 46 causes plunger 48 to compress spring 84 and translate downward out of lockout assembly opening 33, and lever 46 to pivot about exposed end 43 of valve stem 40. Further details of the structure and operation of lockout assemblies can be found in U.S. Pat. Nos. 7,082,972 and 5,178,197, the entire disclosures of both of which are hereby explicitly incorporated by reference herein. By advantageously positioning spring 69 outside of the diaphragm cavity sealed into two cavity halves by diaphragm 80, spring 69 may be much larger and generate a higher spring force than a spring positioned to bias rocker arm 66 and contained within the diaphragm cavity.

With reference to FIG. 7, when fuel dispensing nozzle 20 is engaged with fill pipe 22 of a vehicle or container, nozzle 20 is considered to be in an engaged or active configuration. When nozzle 20 is in the engaged configuration, spout 28 is inserted within fill pipe 22 such that mouth 83 of fill pipe 22 engages engagement plate 52, displacing engagement plate 52 and sleeve 54 axially along spout 28 towards nozzle body 24, compressing spring 56; and protrusion 85 (FIG. 1) of fill pipe 22 slides along tapered lock protrusion 55. Spout 28 is inserted into fill pipe 22 until protrusion 85 of fill pipe 22 engages upstream end 89 of tapered lock protrusion 55. The compression of spring 56 and displacement of engagement plate 52 and sleeve 54 are translated to translation ring 58 (FIG. 6) and connecting push pin 60 such that pin 60 is displaced within elongated opening 59 in spout 28. The displacement of pin 60 is translated to lower push rod 62 and upper push rod 64 causing upper rod spring 69 to compress. When upper push rod 64 is displaced, the second end 67 of upper push rod 64 is extended into lockout assembly opening 31 away from rocker arm 66 and catch 68 such that rocker arm 66 and catch 68 are freely able to rotate counter clockwise (from the perspective of FIGS. 6-8) within lockout assembly opening 31 relative to upper push rod 64. When rocker arm 66 and catch 68 rotate, the first end 66*a* of rocker arm 66 translates downward away from spacer 94 and the second end 66*b* of rocker arm 66, which houses catch 68, rotates upward towards diaphragm 80. When the first end 66*a* of rocker arm 66 translates downward away from spacer 94 and piston 78, compression spring 100 biases diaphragm 80 and tapered body 82 downward towards plunger 48 to an engaged position. When tapered body 82 is in the engaged position, the tapered portion of body 82 is wedged between balls 86 and plunger 48 such that balls 86 are forced outward, away from plunger 48 and are engaged by latch ring 90. When balls 86 are engaged by latch ring 90, plunger 48 is held in place or in an axially stationary configuration and prevented from translating downward when pulled on by lever 46. When plunger 48 is held in position, pressure applied to lever 46 causes lever 46 to rotate about axis A of pivot lever pin 47 and engage valve stem 40 of main fuel valve 30 allowing the pressure to be translated to valve stem 40 of main fuel valve 30 such that fuel may flow through main fuel valve 30.

When fuel dispensing nozzle 20 is delivering fuel to fill pipe 22, a high vacuum pressure may build up in chamber 102 at the upper surface of diaphragm 80 indicating that the fuel reservoir is being filled too fast or the fuel reservoir is full. Seal 19 of removable partition 23 (FIG. 6A) seals and separates passage P from lockout assembly 32, diaphragm 80, and chamber 102, which allows the high vacuum pressure to build up in chamber 102. In the presence of high vacuum pressure, diaphragm 80 is drawn upwards, and tapered body 82 is lifted towards its disengaged position. Raising tapered body 82 to the disengaged position, disengages balls 86 from latch ring 90, allowing downward movement of plunger 48 and the disengagement of main fuel valve 30. This results in an automatic shut-off of main fuel valve 30 to prevent overflow of the fuel reservoir. This type of stop mechanism is described in detail in U.S. Pat. Nos. 7,082,972 and 5,178,197, the entire disclosures of both of which are explicitly incorporated by reference herein.

In addition, fuel dispensing nozzle 20 generally includes a fuel pump on/off lock out mechanism 106 (FIG. 6A). Fuel pump on/off lock out mechanism 106 is configured to prevent fuel dispensing nozzle 20 from actuating, even if in contact with fill pipe 22, if the fuel pump coupled to nozzle 20 has not been actuated or turned on. Specifically, when the fuel pump coupled to nozzle 20 is energized, it supplies pressurized fuel to passageway P. Even before operating lever 46 to allow flow of fuel through nozzle 20, passageway P is pressurized upstream of main fuel valve 30. Pressure upstream of main fuel valve 30 is also communicated to the area above piston 78 to prevent piston 78 from restricting downward movement of tapered body 82. This type of lock out mechanism is described in detail in U.S. Pat. Nos. 7,082,972 and 5,178,197, the entire disclosures of both of which are explicitly incorporated by reference herein.

With reference to FIGS. 6-8 and, particularly to FIGS. 14-18, fuel dispensing nozzles 20, 20' further include check valve 110 positioned upstream of passage $P_2$ within spout 28 and passage $P_1$ between check valve 110 and spout 28, and downstream of passage P within nozzle body 24, 24'. Check valve 110 includes valve body 111 (FIG. 16), which selectively seats on valve seat 115. Insert 113 holds valve seat 115 in operative position sealed to nozzle body 24. Check valve 110 is configured to open when pressure from fuel in passage P within nozzle body 24, 24' overcomes the spring force of spring 114, which biases valve body 111 into seated, sealing relationship with valve seat 115. Check valve 110 closes when pressure from fuel in passage P within nozzle body 24 is overcome by the spring force of spring 114.

Figure 14:
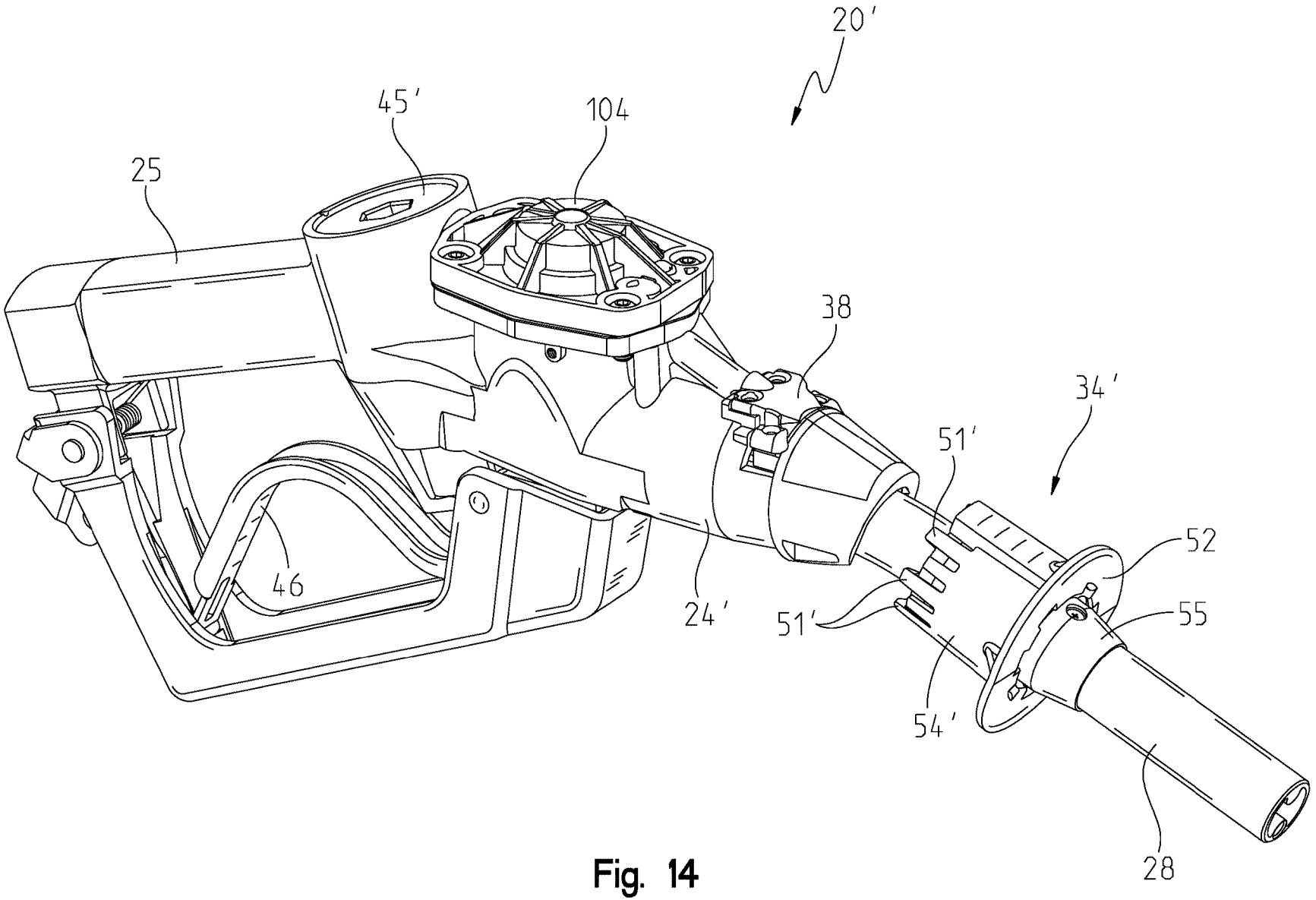
FIG. 14 shows a perspective view of a second embodiment of a fuel dispensing nozzle of the present disclosure.
Figure 15:
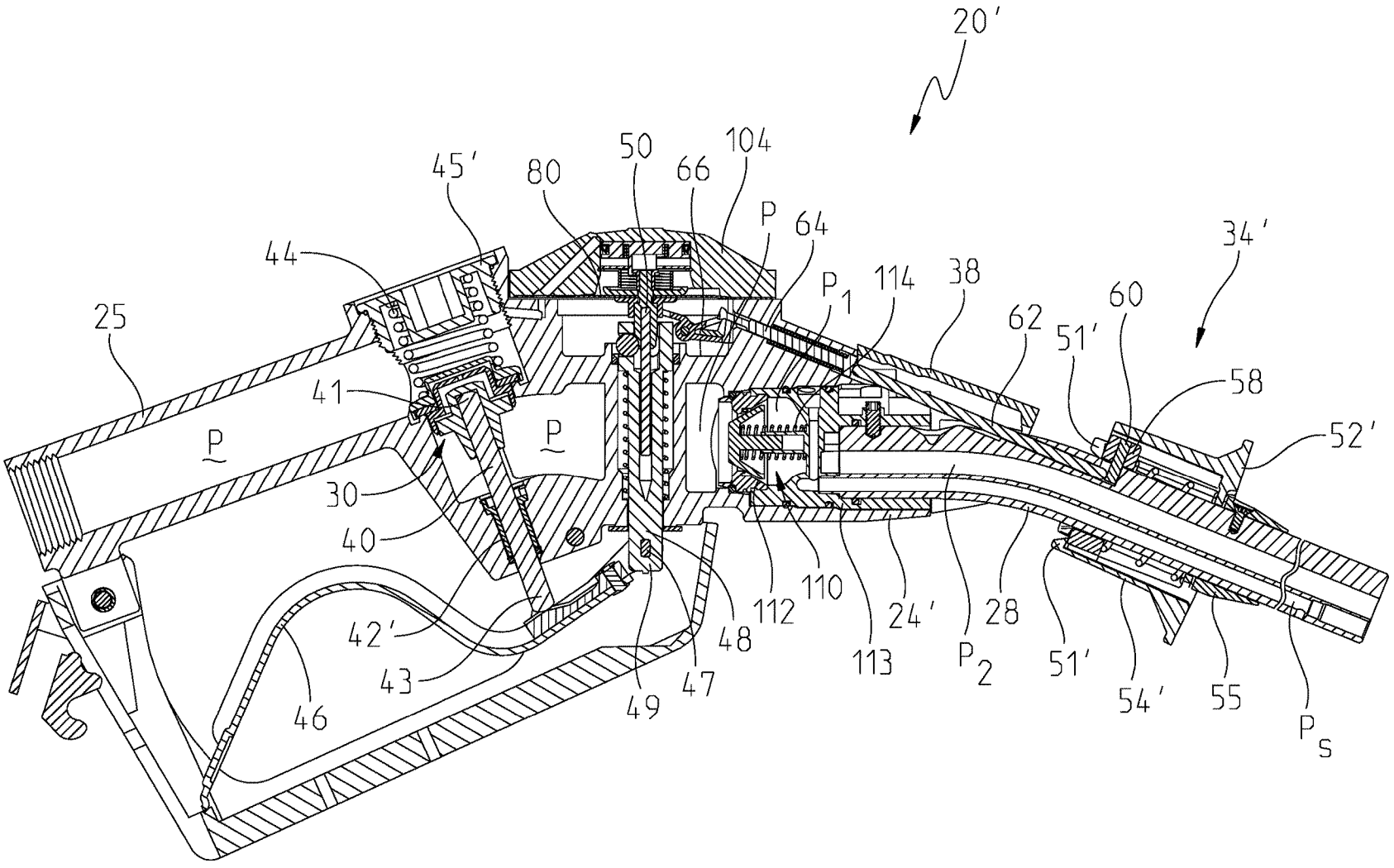
FIG. 15 shows a cross-sectional view of the fuel dispensing nozzle of FIG. 14.
Figure 16:
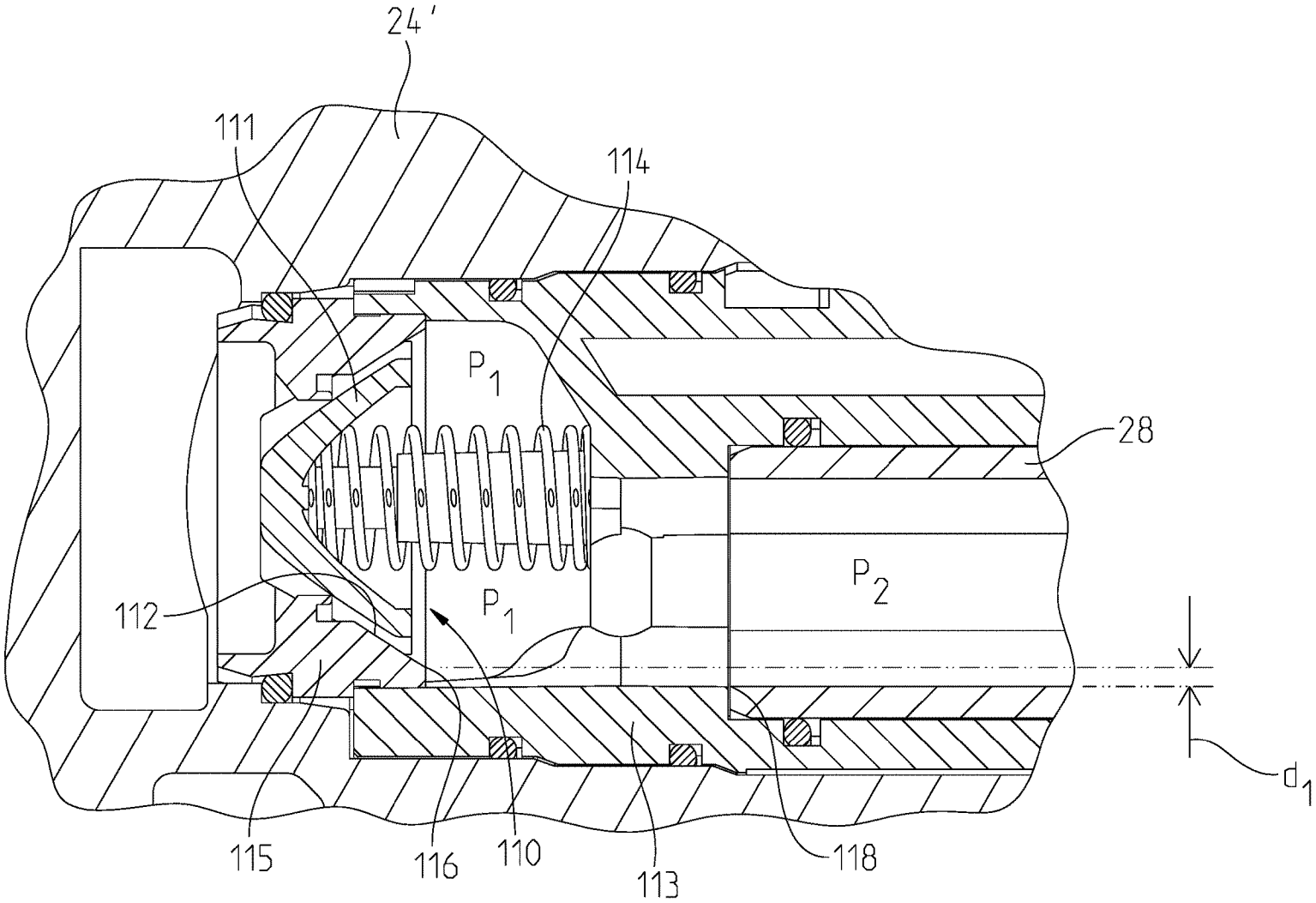
FIG. 16 shows a detailed cross-sectional view offset forward from center of a check valve and a first end of a spout of the fuel dispensing nozzle of FIG. 14.
Figure 17:
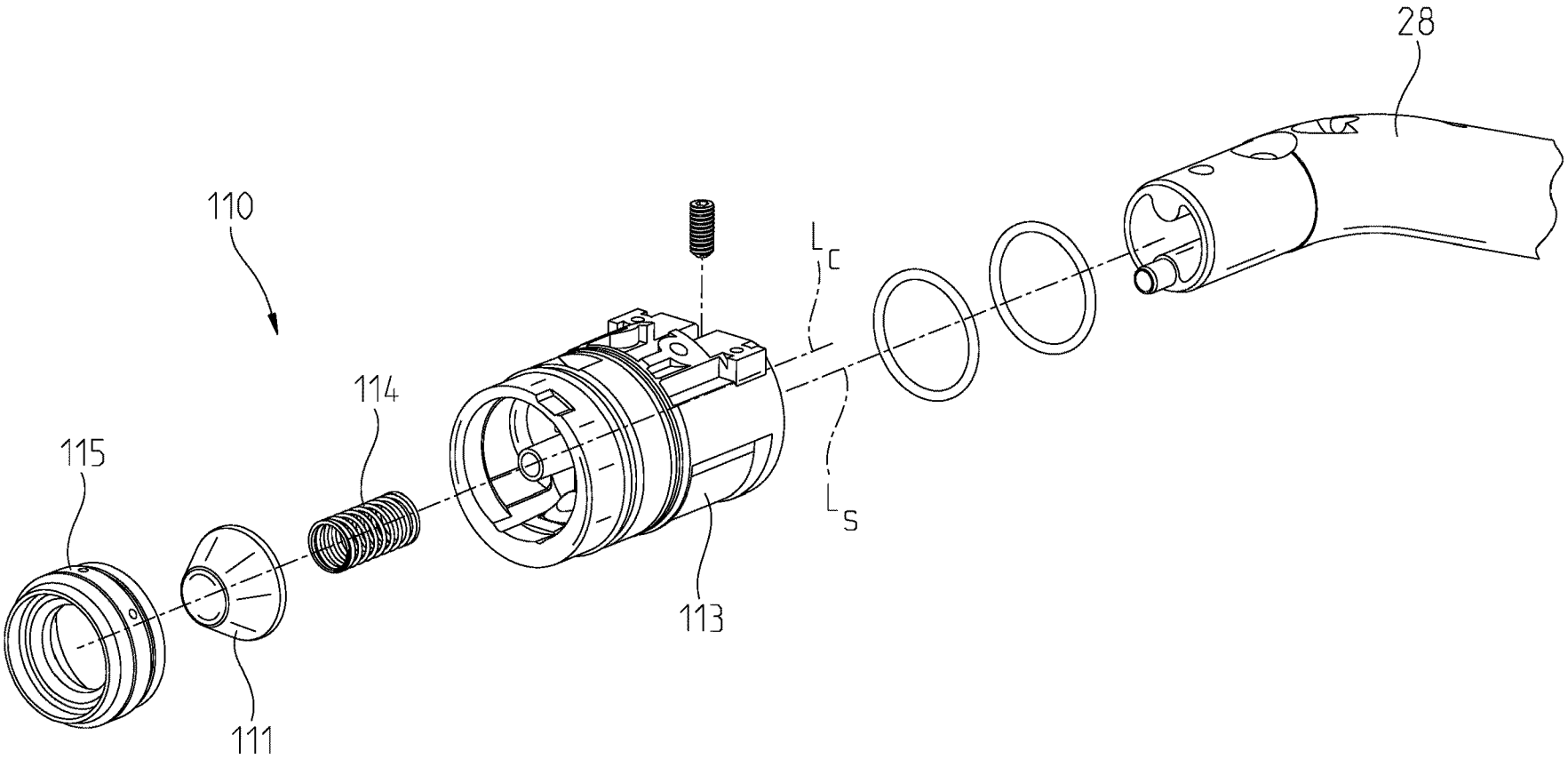
FIG. 17 shows an exploded view of the check valve and the spout of FIG. 16.
Figure 18:
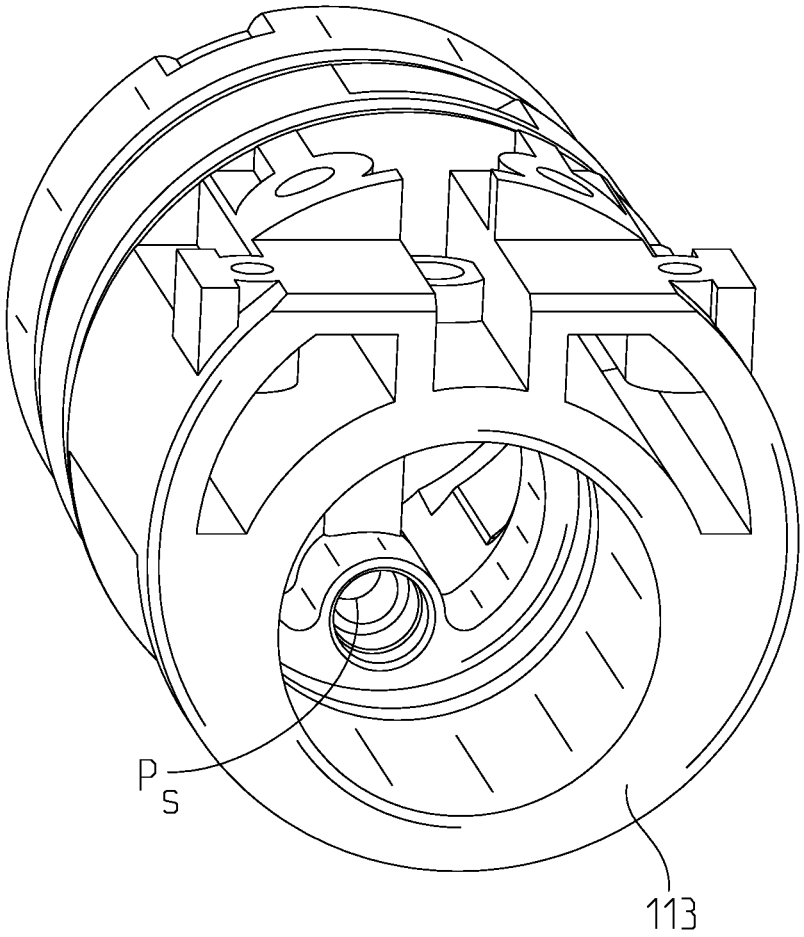
FIG. 18 shows a perspective end view of a check valve body of the check valve of FIG. 17.

With reference to FIGS. 14-18, check valve 110 is positioned such that its longitudinal axis $L_c$ is offset from the longitudinal axis $L_s$ of the first portion of passage $P_2$ in spout 28 (see FIGS. 16 and 17). Particularly, check valve 110 is positioned so that a bottommost point 116 of check valve seat 112 and the passage $P_1$ is a distance $d_1$ higher than a bottommost point 118 of passage $P_2$ within spout 28 (FIG. 16) when the fuel dispensing nozzle of FIGS. 14-16 is positioned to dispense fuel. The positioning of check valve 110 as shown in FIGS. 14-16 allows fuel dispensing nozzle 20 to be "dripless" or "drip-free". More specifically, during normal use, fuel dispensing nozzle 20 is tilted forward such that the entire passage $P_2$ within spout 28 has a downward grade that allows gravity to force any fuel or hydrocarbon product remaining in passages $P_1$ and $P_2$ out. Furthermore, the positioning of check valve 110 shown in FIGS. 14-16 results in fuel downstream of check valve 110 and/or passage $P_1$ being directed out of spout 28 through passage $P_2$ rather than being allowed to pool or become trapped within check valve 110 and/or passage $P_1$ between check valve 110 and spout 28 during or after dispensing.

It is worth nothing that the low point 118 (FIG. 17) of passageway $P_2$ is found adjacent to the exterior of shutoff passage Ps (FIG. 15), which communicates with the chamber above diaphragm 80 to allow for automatic shutoff of nozzle 24. Nozzle 20' is designed so that the fuel conveying passageway from valve body 111 to the distal most end of nozzle 20' (i.e., the exit point of nozzle 20') has a low point when nozzle 20' is positioned to dispense fuel that defines a continuous downward slope from valve body 111 to the exit point of nozzle 20', with no low areas to allow for pooling of fuel. In this way, all of the fuel downstream of valve body 111 when valve body 111 closes will exit the nozzle via gravity prior to removal of nozzle 20' from the fuel reservoir it is filling. Therefore, fuel nozzle 20' is not be susceptible to dripping fuel after filling is complete and can be termed a dripless or drip free nozzle. The embodiment of FIGS. 14-18 is illustrated primarily to convey a dripless configuration of the present nozzle design. Numerous parts of nozzle 20' are shared with nozzle 20 and are indicated by like reference numerals. In the event that a corresponding element of nozzle 20' differs from its counterpart in nozzle 20, such part is indicated by a primed reference numeral.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A fuel dispensing nozzle comprising:

a nozzle body, said nozzle body defining a nozzle body fuel passageway and a diaphragm cavity;

a fuel delivery spout extending from said nozzle body, said fuel delivery spout defining a spout fuel passageway, said nozzle body fuel passageway in fluid communication with said spout fuel passageway to form a nozzle passageway capable of conveying a quantity of fuel from a source of said quantity of fuel through said nozzle body and said spout to a fuel reservoir;

a fuel valve disposed in said nozzle passageway, said fuel valve actuatable to allow a flow of said fuel through said nozzle passageway;

a lockout plunger including a longitudinal axis, said lockout plunger having an active configuration allowing actuation of said fuel valve and an inactive configuration preventing actuation of said fuel valve;

a rocker arm rotatably supported relative to said nozzle body, said rocker arm rotatable to a stop position maintaining said lockout plunger in said inactive configuration preventing actuation of said fuel valve; and a spring positioned and oriented to selectively supply a spring bias to said rocker arm, said rocker arm rotatable over a range of motion, said rocker arm having an operative condition in which said rocker arm is freely rotatable over said range of motion, whereby said spring bias does not influence movement of said rocker arm in said operative condition, said rocker arm having a stop condition in which said spring bias maintains said rocker arm in said stop position to maintain said lockout plunger in said inactive configuration preventing actuation of said fuel valve.

2. The fuel dispensing nozzle of claim 1, wherein said spring is positioned outside of said diaphragm cavity.

3. The fuel dispensing nozzle of claim 1, further comprising:

a push rod selectively engageable with said rocker arm, said spring supplying the spring bias to said rocker arm by supplying the spring bias to the push rod to bias the push rod to engage the rocker arm and maintain said rocker arm in said stop position.

4. The fuel dispensing nozzle of claim 3, wherein said spring is positioned about the push rod.

5. The fuel dispensing nozzle of claim 3, wherein said push rod has an actuated position in which said push rod disengages said rocker arm and said rocker arm can freely rotate from said stop position, said push rod positioned to be actuated to said actuated position by insertion of said spout into the fuel reservoir.

6. The fuel dispensing nozzle of claim 1, wherein said active configuration of said lockout plunger comprises a stationary configuration of said lockout plunger, said fuel dispensing nozzle further comprising:

a nozzle lever pivotable about a pivot extending from said plunger to actuate said fuel valve to allow said flow of said fuel through said nozzle passageway, wherein said inactive configuration of said plunger comprises a moveable configuration of said plunger, whereby said pivot is moveable in said inactive configuration to prevent said nozzle lever from actuating said fuel valve to allow said flow of said fuel through said nozzle passageway.

7. The fuel dispensing nozzle of claim 1, wherein said nozzle body comprises a plurality of passages extending from an exterior of said nozzle body inward, each of said plurality of passages having one of a consistent cross-sectional size throughout a length of said passage and a decreasing cross-sectional size throughout said length of said passage, whereby no buried passages are formed in said nozzle body and whereby, owing to said lack of buried passages, said nozzle body can be die cast, and wherein said fuel dispensing nozzle further comprises:

a partition selectively securable in at least one of said plurality of passages to fluidly seal a portion of said at least one of said plurality of passages to define a pair of passages, each terminating at said partition, at least one of said pair of passages comprising a buried passage.

8. The fuel dispensing nozzle of claim 3, wherein said spout defines a blind bore formed in a wall of said spout, said blind bore defining an opening in said wall of said spout and running from said opening to a terminal end defined within said wall, said push rod positioned in said blind bore.

9. The fuel dispensing nozzle of claim 3, wherein said rocker arm includes a first end having a cutout between a pair of protrusions, and a first end of said push rod is positioned within said cutout of said rocker arm, said first end of said push rod comprising a bulbous end positionable to bear against said pair of protrusions in said stop position of said push rod.

10. The fuel dispensing nozzle of claim 9, wherein said rocker arm further includes a second end, said second end including a first protrusion and a second protrusion separated by a gap, said longitudinal axis of said plunger intersecting said gap between said first protrusion and said second protrusion at said second end of said rocker arm.

* * * * *